US007260856B2

(12) United States Patent
Kelly et al.

(10) Patent No.: US 7,260,856 B2
(45) Date of Patent: Aug. 28, 2007

(54) STACKABLE COT ASSEMBLY

(75) Inventors: Ray G. Kelly, St. Louis, MO (US); Paul A. Pilosi, Minnetonka, MN (US); Martijn Loerakker, Minneapolis, MN (US)

(73) Assignee: Angeles Corporation, Pacific, MO (US)

( * ) Notice: Subject to any disclaimer, the term of this patent is extended or adjusted under 35 U.S.C. 154(b) by 3 days.

(21) Appl. No.: 10/910,758

(22) Filed: Aug. 3, 2004

(65) Prior Publication Data

US 2005/0039257 A1 Feb. 24, 2005

Related U.S. Application Data

(60) Provisional application No. 60/541,084, filed on Feb. 2, 2004, provisional application No. 60/496,534, filed on Aug. 20, 2003.

(51) Int. Cl.
*A47C 17/64* (2006.01)

(52) U.S. Cl. ..... 5/8; 5/110; 5/114

(58) Field of Classification Search ..... 5/110, 5/111, 112–117, 123, 201, 99.1
See application file for complete search history.

(56) References Cited

U.S. PATENT DOCUMENTS 4,646,371 A * 3/1987 Nowell ..... 5/200.1
4,800,601 A * 1/1989 DeCaro ..... 5/123
5,003,649 A 4/1991 Kelly
D328,401 S 8/1992 Kelly
5,263,424 A 11/1993 Kelly et al.
5,396,846 A 3/1995 Kelly et al.
5,658,642 A * 8/1997 Strongwater ..... 428/161
5,799,348 A * 9/1998 Hsu ..... 5/123
6,513,178 B1 * 2/2003 Kelly et al. ..... 5/110
6,564,400 B2 * 5/2003 Kelly et al. ..... 5/8

* cited by examiner

*Primary Examiner*—Patricia Engle
*Assistant Examiner*—Fredrick Coney
(74) *Attorney, Agent, or Firm*—Woodard, Emhardt, Moriarty, McNett & Henry LLP

(57) ABSTRACT

In certain preferred embodiments, the present invention provides a cot assembly that includes side pieces, supporting end pieces and bedding material. Preferably the cot assembly holds the end pieces a spaced apart distance, and in one feature allows a side piece to be selectively released. In one embodiment, the end pieces move towards each other to release a side piece, optionally by sliding a side piece through an end piece channel. In one preferred embodiment, the bedding material is mounted to and retained by the end pieces and extends across the interior of the cot to overlap or enclose the side pieces without any gaps between the material, the side pieces and the end pieces. In other embodiments, the invention includes an improved method for attaching the material to the end pieces and an improved cot assembly method. In a preferred option, the bedding material is continuously attached to the end piece along a portion of an end piece. In an alternate optional feature, the end pieces have a curved profile, with a middle portion higher than the end portions.

46 Claims, 25 Drawing Sheets

STACKABLE COT ASSEMBLY

This application claims the benefit of provisional application Ser. No. 60/541,084 filed Feb. 2, 2004 and provisional application Ser. No. 60/496,534 filed Aug. 20, 2003 both of which are hereby incorporated herein by reference.

FIELD OF THE INVENTION

The present invention relates generally to cots, and more particularly to an improved design for a cot assembly and features. In certain embodiments, the invention further relates to cots having various advantageous features, including a continuous bedding surface without gaps, increased rigidity, and an improved low profile for stacking.

BACKGROUND OF THE INVENTION

Cots provide a temporary sleeping surface positioned above the ground or floor. Preferably, a cot is easily moved and transported and/or stored for later use. Cots find a wide variety of uses in many different activities for different ages and sizes of people. In one use, cots are used for camping or other outdoor sleeping settings to avoid contact with the ground. In another use, cots are used indoors by children or preschoolers when it is desired to provide a comfortable sleeping surface that is raised above the floor. Cots are more advantageous than mats or other devices that lie directly on the floor or ground for many reasons. For example, they provide a more comfortable sleeping surface, allow air flow between the floor or ground and the sleeping surface, provide a sleeping surface for a person which is not in contact with the sleeping surface of another person when in storage, and do not expose the sleeping person to filth and/or pests which may be present on the floor or ground.

One problem associated with cots is the fact that, when assembled, they require more storage space and can be more cumbersome than mats or sleeping bags. In order to address this problem, various improvements have been made in the design of cots. U.S. Pat. Nos. 5,003,649 and 6,564,400 to Kelly provide nestable cots with a frame that allows a plurality of cots to be nestably stacked one on top of another. Each cot includes four corner pieces, each corner piece configured to receive a pedestal from a corresponding one of the corner pieces stacked thereupon. Thus, the stacked cots occupy a space that has a total height that is less than the sum of the individual heights of each cot, and are more easily stored and handled.

While the '649 and '400 patents are steps in the right direction in improving the design of cots, there remains room for additional improvements. One problem with some prior art cots is related to the sleeping surface of the cots. Cots typically have a frame for supporting bedding material or fabric that extends between members of the frame. One of the problems with these prior art cots is that gaps are formed between the bedding material and the frame, and these gaps may pose a safety hazard, particularly for children. The potential for injury exists if a child inserts a hand, foot, head or other body part through the gap, where it may become stuck or may cause the child to trip and fall. Also, the cot is more susceptible to being damaged. Cots having such gaps, particularly at the corners, have been prevalent in the prior art and means have not been provided for ensuring against such gaps.

Another problem with some prior art cots is related to maintaining the rigidity of the cots in a generally flat orientation. Most cots are based on a frame of multiple pieces connected to corner pieces or each other to form a frame. The tension on the frame from the bedding material can cause these pieces to warp or twist, imparting a warp or twist to the cot, inhibiting the cot from lying flat. This problem becomes worse over time as the cot is repeatedly subjected to loading.

A further problem in some prior art cots has been the time and cost of shipping and assembly. Cots can be shipped fully assembled, which takes extra space and thus costs more, or can be shipped disassembled, which requires time, energy and typically tools for a user to assemble the cot. There is a need to balance these factors.

While there have been various approaches to improving the design and construction of nestable cots, the need for improvement still remains. There is needed an improved cot that addresses the problems in the prior art in a reliable, safe, durable and efficient manner. The present invention satisfies these needs, among others.

SUMMARY OF THE INVENTION

In certain preferred embodiments, the present invention provides a cot assembly that includes side pieces, supporting end pieces and bedding material. Preferably the side pieces hold the end pieces a spaced apart distance, and in one feature the cot assembly allows a side piece to be selectively released. In one embodiment, the end pieces move towards each other to release a side piece, optionally by sliding a side piece through an end piece channel. In one preferred embodiment, the bedding material is mounted to and retained by the end pieces and extends across the interior of the cot to overlap or enclose the side pieces without any gaps between the material, the side pieces and the end pieces. In other embodiments, the invention includes an improved method for attaching the material to the end pieces and an improved cot assembly method.

In a preferred option, the bedding material is continuously attached to the end piece along a portion of the end piece. In an alternate optional feature, the end pieces have a curved height profile, with a middle portion higher than the end portions.

In a further aspect of certain embodiments of the present invention, the cot assemblies can be stacked using low-profile end pieces. Optionally the end pieces include one or more pedestals with internal pockets. Preferably a plurality of stackable cots can be vertically stacked such that each pocket in a cot assembly slidably receives a corresponding pedestal of the cot assembly placed atop it. Further, preferably each cot assembly has a height and the height of the stacked cots is only increased by approximately the height of the end piece each time a cot is placed atop the stack. In one preferred feature, rectangular side frame members with rounded corners take less vertical space and permit closer stacking.

In a further feature in certain preferred embodiments, the end pieces and bedding material are assembled as a partial cot assembly for compact shipment or storage without the side frame pieces assembled. The complete cot assembly is easily assembled when desired. Preferably the cot may be assembled without tools or fasteners.

Objects and advantages of the present invention will be apparent from the following description of the preferred embodiments.

DESCRIPTION OF THE PREFERRED EMBODIMENTS

Figure 1:
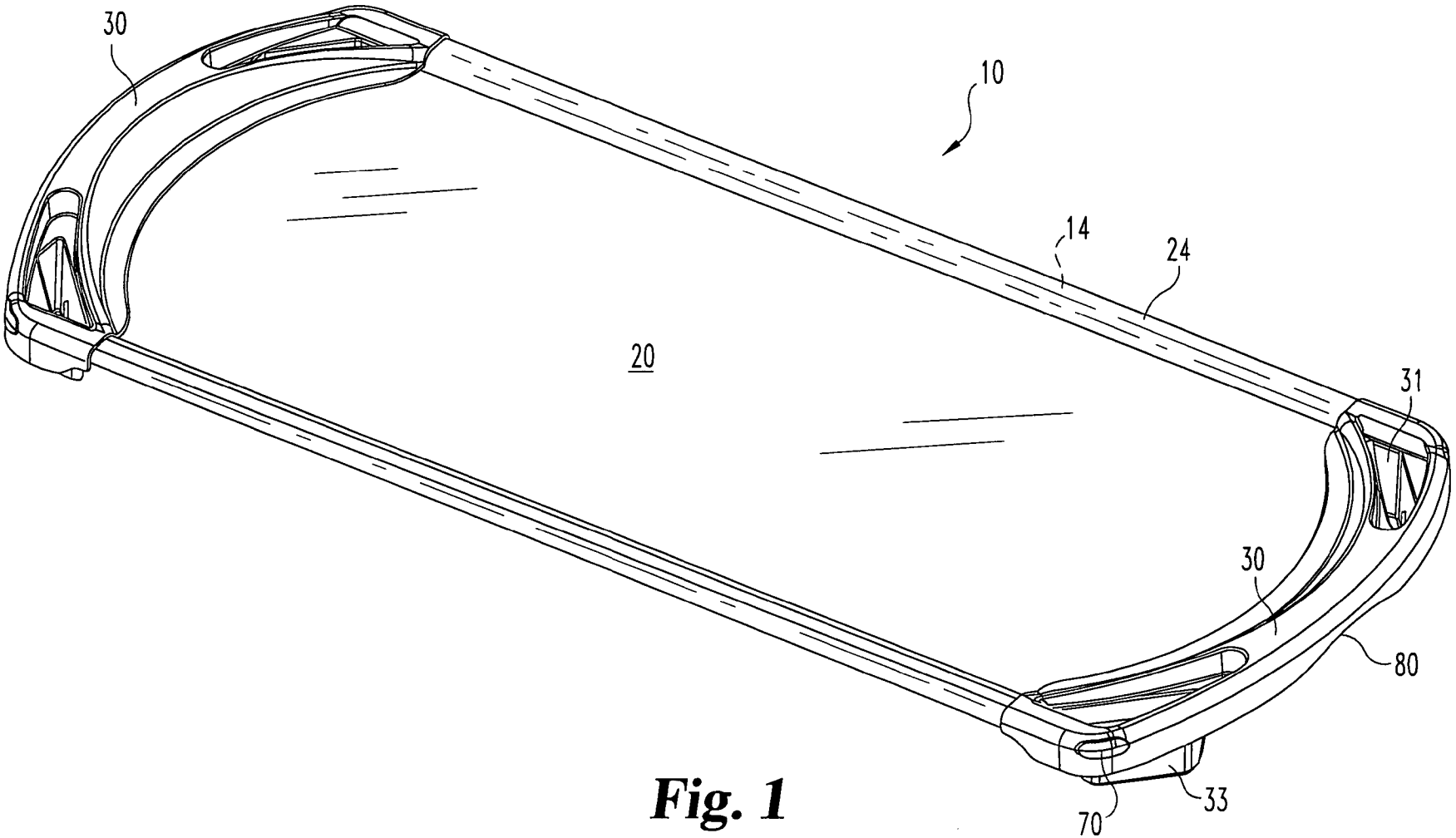
FIG. 1 is a perspective view of a cot assembly according to a preferred embodiment of the present invention.
Figure 2:
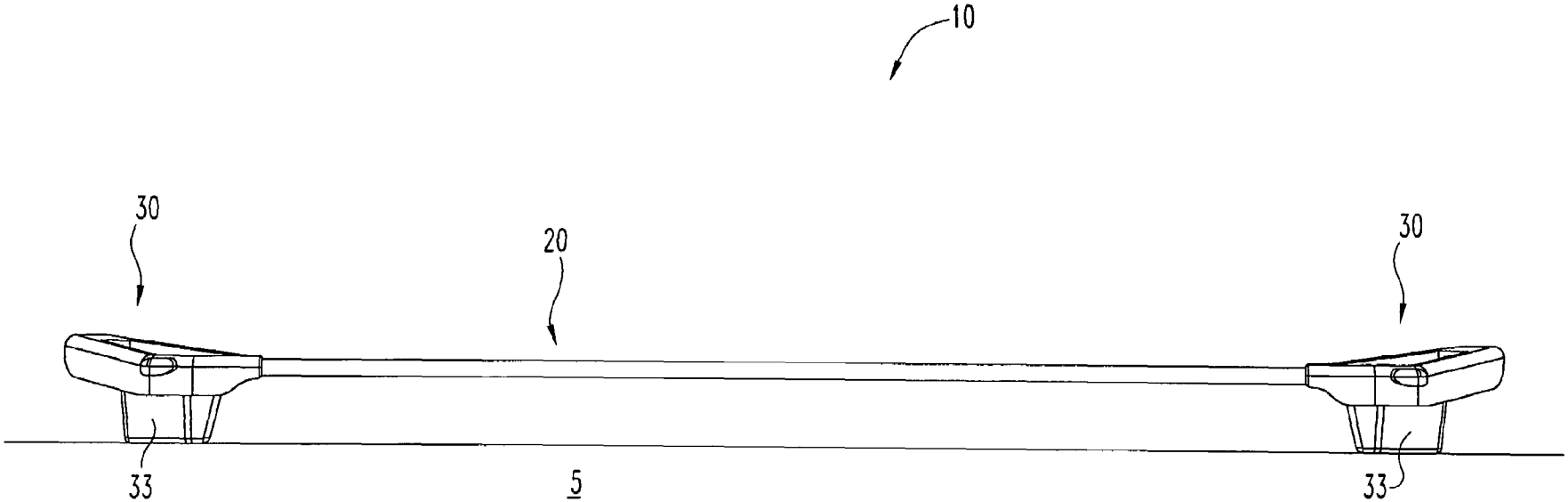
FIG. 2 is a side view of the cot of the embodiment of FIG. 1.
Figure 3:
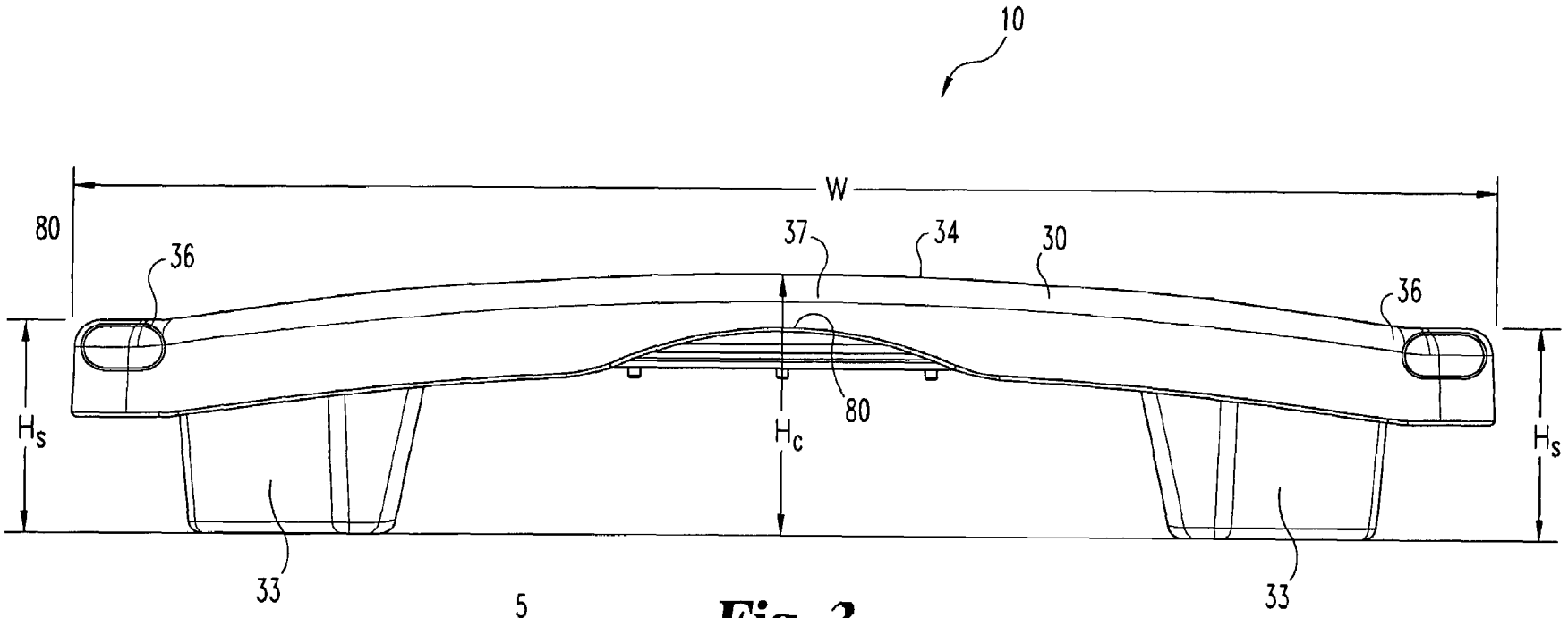
FIG. 3 is an end view of the cot assembly of FIG. 1.
Figure 4A:
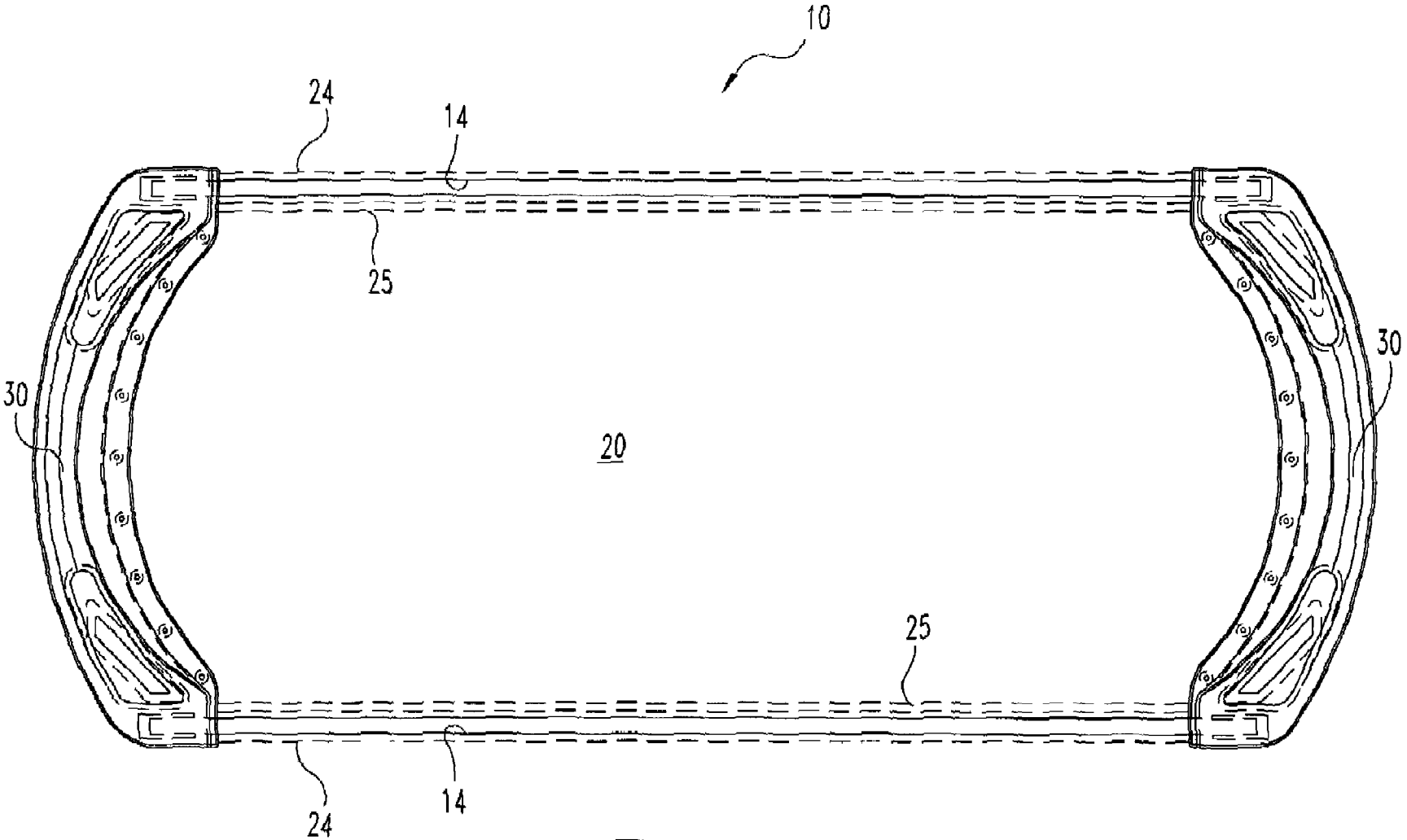
FIGS. 4A-C are top views and end views of the assembly of FIG. 1.
Figure 4B:
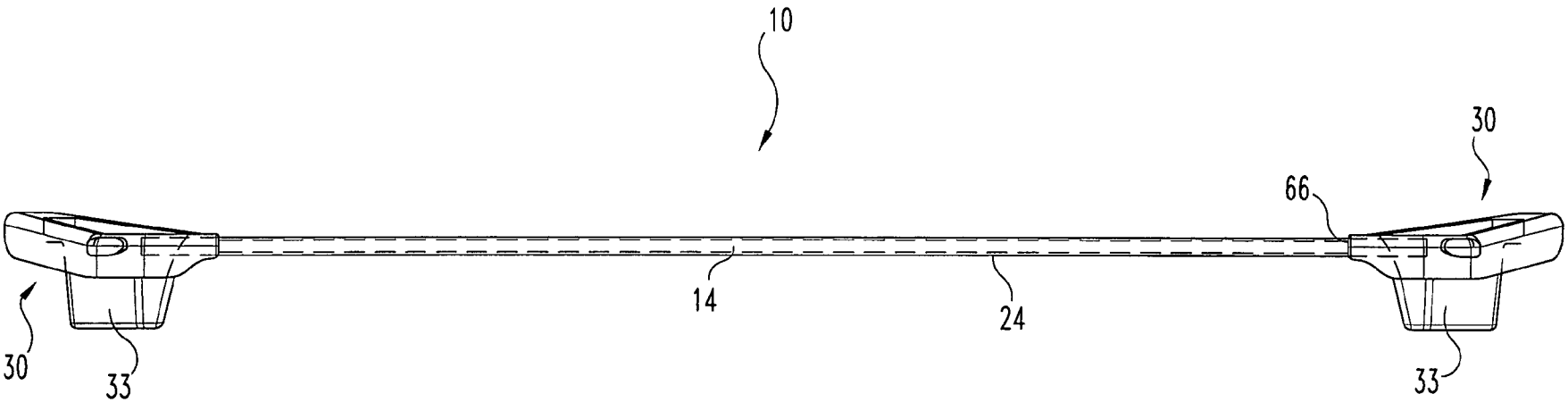
Figure 4C:
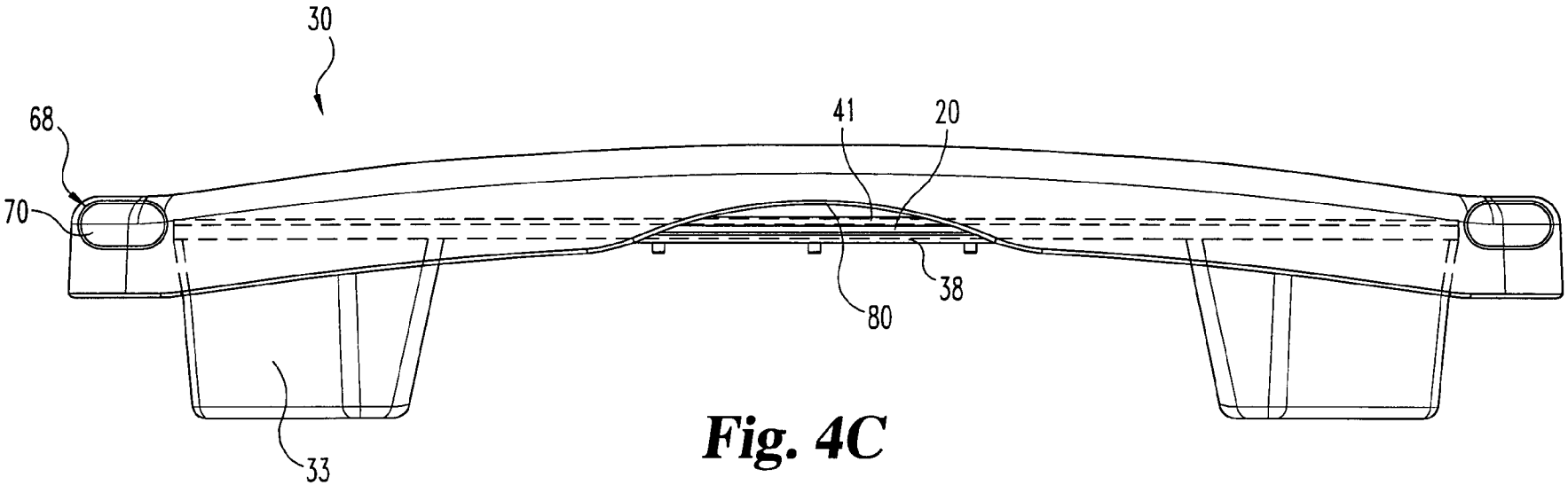

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In preferred embodiments, the present invention provides a cot assembly that has several advantageous design features not available in the prior art. The cot includes a bedding material that preferably spans the entire interior of the cot frame without any gaps being present between the bedding material and the frame. The bedding material and side frame pieces are mounted to and supported by two end pieces which securely and safely receive and hold the side frame pieces and the bedding material. The side pieces and end pieces form a perimeter frame which defines an interior area in which a person lying on the cot is supported and an exterior outside the frame. These features preferably are provided in a cot assembly that is simple and reliable in construction, is easily shipped, is easily assembled, and does not have exposed parts that may pose a problem for the user, particularly for children.

FIGS. 1-4C show general views of a cot 10, on support surface 5, having two side frame pieces 14 and two end pieces 30. FIG. 4A illustrates end pieces 30 and side pieces 14 in solid lines, with the edges of material 20 in dotted lines; whereas FIG. 4B illustrates side pieces 14 in dotted lines.

Figure 5A:
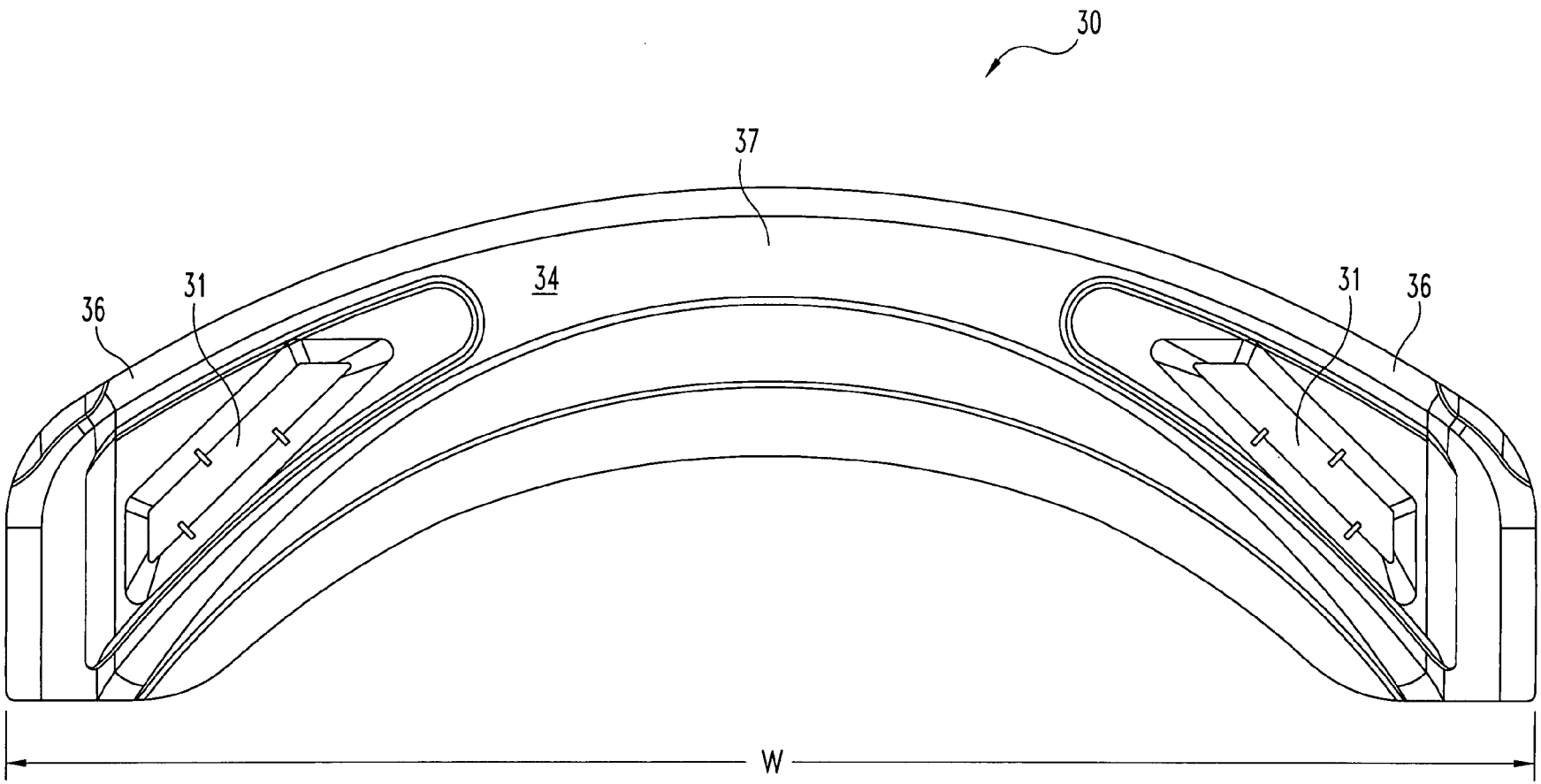
FIGS. 5A-C are top, inside, and end views of the end piece illustrated with the cot in FIG. 1.
Figure 11A:
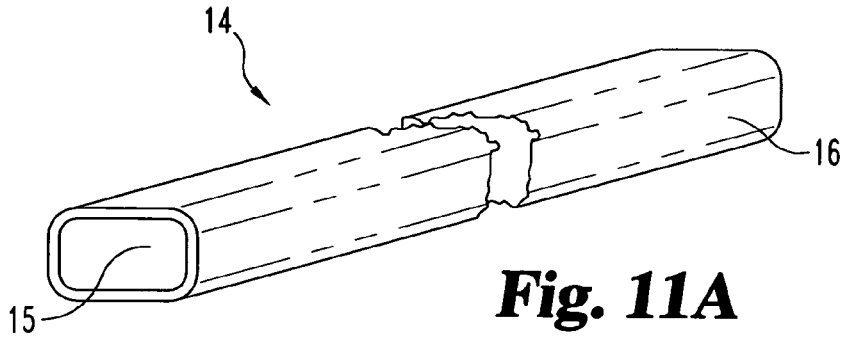
FIG. 11A is a perspective view of a side piece according to a preferred embodiment of the present invention.

The end pieces 30 (shown in detail in FIGS. 5A-C) receive and retain side frame pieces 14 (shown in detail in FIG. 11A). It is contemplated herein that cot 10 may have a plan view forming any one of a number of polygonal shapes, such as a rectangle, square, pentagon, a combination of straight and curved members, or only curved members, etc., and including a corresponding number of end pieces and side pieces. A substantially rectangular cot is shown for illustration.

Each end piece 30 defines a width W (FIG. 3) with a central portion 37 and two side portions 36. Preferably central portion 37 has a central height $H_c$ with a highest point at a greater height than the highest points of the side heights $H_s$ of side portions 36. Preferably end piece 30 has a top surface 34 (FIGS. 5A-C) with a curved height contour or "rising curve" profile across width W of end piece 30. The rising-curve profile preferably provides additional strength and rigidity to the end piece. Curvatures of this type are an improvement over the prior art, where it was not practical when using tube pieces on the end edges. Optionally, end piece 30 defines a formed handle or grip 80.

Figure 5B:
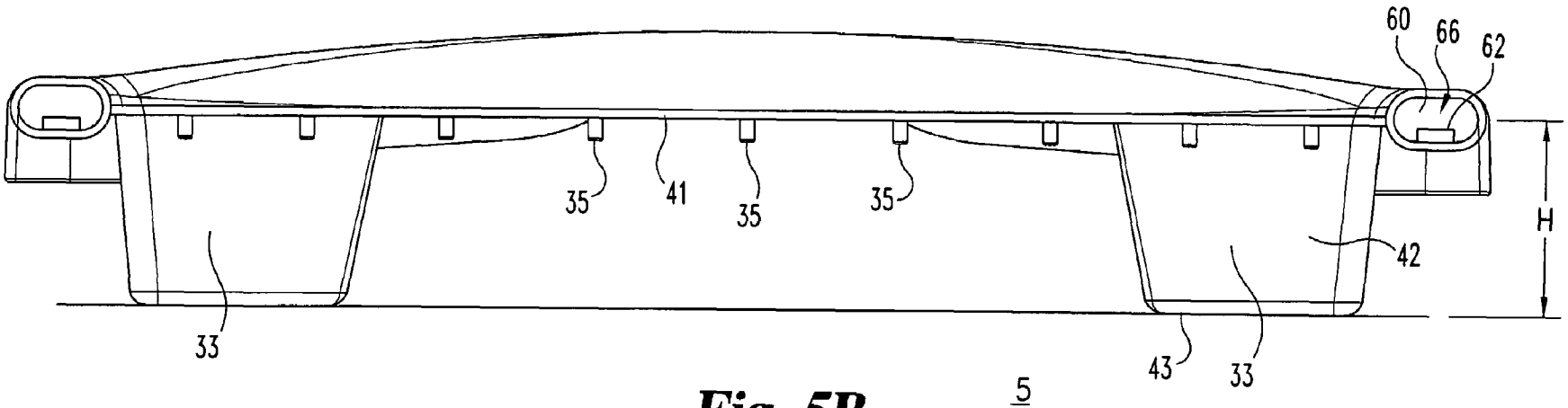

As shown in FIG. 5B, each end piece 30 includes at least one support means such as a leg or pedestal 33 defined by an outer wall surface 42, which optionally tapers to a reduced cross-section as it extends downwardly to bottom 43. Pedestal 33 has a height from the floor that positions bedding material 20 above the ground or floor 5 with a cot height H.

Each end piece 30 preferably also defines at least one pocket 31 positioned through the interior of each pedestal 33. Pocket 31 includes substantially vertical inner walls which preferably taper slightly inwardly in correspondence to outer walls 42 as they extend downwardly towards pedestal bottom 43. Pocket 31 can include internal bracing 32 (FIG. 13) for supporting pedestal 33 as well as limiting the nesting distance for stacked cots.

Bottom 43 of pedestal 33 may define one or more openings (not shown) communicating with the interior of pocket 31. The openings provide a passageway for air as a pedestal is inserted into or removed from the pocket 31, thus facilitating the stacking and unstacking of cots. The openings also facilitate drainage of the pedestal when a cot is wet, for example, when being cleaned. End piece 30 may be made from a variety of materials, as would be understood by those of skill in the art. Examples include plastic, metal or wood. Preferably end pieces 30 are cast or injection molded plastic.

Figure 5C:
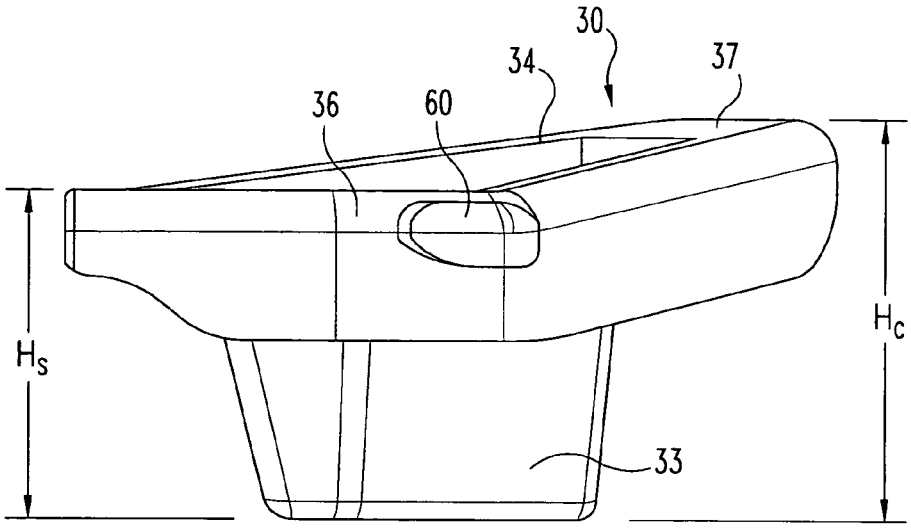
Figure 6:
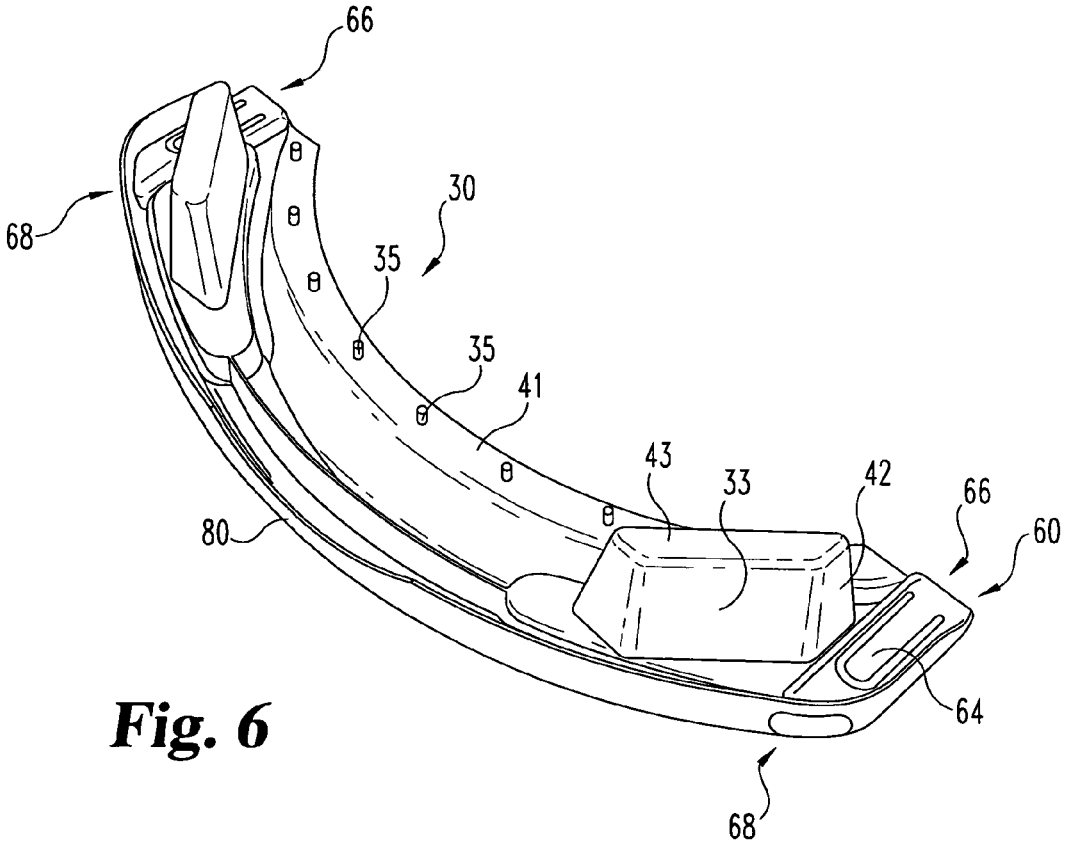
FIGS. 6-10 illustrate one material to end piece assembly method for the cot of FIG. 1.

As shown in FIGS. 5B, 5C and 6, the side portions 36 of end piece 30 preferably define interior channels 60 each having a cot interior opening 67 adjacent the cot inner area and an exterior opening 68. Preferably communicating with each channel 60 is a tongue 64 having a retaining tang 62 (see also FIGS. 11A-B). Preferably channel 60 has a cross-section sized to slidably receive a corresponding side piece 14. Exterior opening 68 is optionally sized to receive a plug 70.

The side frame pieces 14 (shown in detail in FIG. 11A) are shown as a pipe generally comprised of a hollow tube either in a round or non-round cross-section. Oval or substantially rectangular with rounded corners is one non-round preferred cross-section which assists in reducing stacking height. Each frame piece or member is preferably an elongate member such as a metal pipe or tube. Optionally, frame pieces may be bent or curved to form the complete periphery of a polygonal shape. Each side piece preferably includes two ends, forming a proximal end portion 15 and a distal end portion 16.

As used herein, the term "tube" is used more broadly as encompassing any elongated rod or member which can be straight, curved and/or bent to form a frame for supporting the bedding material used in a typical cot. A "tube" may be solid, but is preferably hollow to reduce weight. It will therefore be appreciated that such tubes may comprise any of a wide variety of materials and shapes depending on the intended use of the cot. A hollow galvanized steel pipe is one preferred material. Alternate materials such as molded or extruded plastic or aluminum may also be used when made to have sufficient strength to support the taut bedding material during use, but which preferably are also light-weight to facilitate moving and stacking of the cots.

As shown in FIGS. 1, 2, 4A and 4B, bedding material 20 is connected to end pieces 30 and extends in the interior area to create a support surface for a person lying on the cot. The bedding material 20 extends horizontally, substantially parallel to the floor or ground 5. The bedding material 20 is made from a material of suitable strength and comfort to support a person lying on the cot 10, the selection of which is within the ordinary skill in the art. Bedding material is typically a relatively thin, flexible and compliant material, preferably sheet-like in shape. The material may be any suitable one, e.g., a natural or synthetic sheeting, fabric, mat, webbing or the like.

The bedding material 20, end pieces 30, and side tube or frame pieces 14 are preferably assembled such that there are no gaps formed between the bedding material, end pieces 30 and the side pieces 14 in the interior area of the cot in which a part of a person's body may be received. The bedding material is preferably engaged to the end pieces along a portion of the end piece, discussed in detail below. As shown with dotted lines for the edges and seams of bedding material 20 in FIG. 4A, the side portions of the bedding material preferably will at least extend to or overlap with the side frame pieces and in certain embodiments enclose the side pieces. The bedding material may be attached to the side frame pieces either before or after the cot is completely assembled.

It will be appreciated that there are numerous ways of attachment. In one preferred embodiment, shown from a bottom view in FIG. 4A, the bedding material includes sewn or sealed sleeves 24, each configured to enclose a side frame piece 14. Alternately, if the side pieces and end pieces are assembled first, the bedding material will need to be attached around the rigid frame. For example, bedding material 20 may extend around the exterior portion of the side frame pieces 14 and be connected to the underside of the material or the frame by suitable fasteners 25, for example Velcro® hook and loop fasteners, snaps, buttons, zippers, a heat seal, rivets, or other fasteners, the selection of which is within the ordinary skill in the art.

Bedding material 20 is sized such that when the side frame pieces 14 and end pieces 30 are assembled, and shown in FIG. 1, the bedding material 20 fills the interior area of cot 10 without gaps. In a less preferred embodiment, the present invention could be made with side members which do not attach to or do not overlay the bedding material. Such an arrangement may allow gaps between the bedding material and the side frame pieces. Preferably the material resists stretching to retain the end pieces from moving a distance apart which substantially exceeds a desired spaced apart distance.

As used herein, the term "gap free" or similar terms are used to describe the fact that the bedding material fills the interior of the area defined by the frame perimeter and the end pieces when viewed in the plan view such that no openings are defined which could receive a portion of a person's body. Moreover, a preferred feature of the present invention is the provision of a gap free condition that is maintained while the bedding material is stretched during use.

Figure 9:
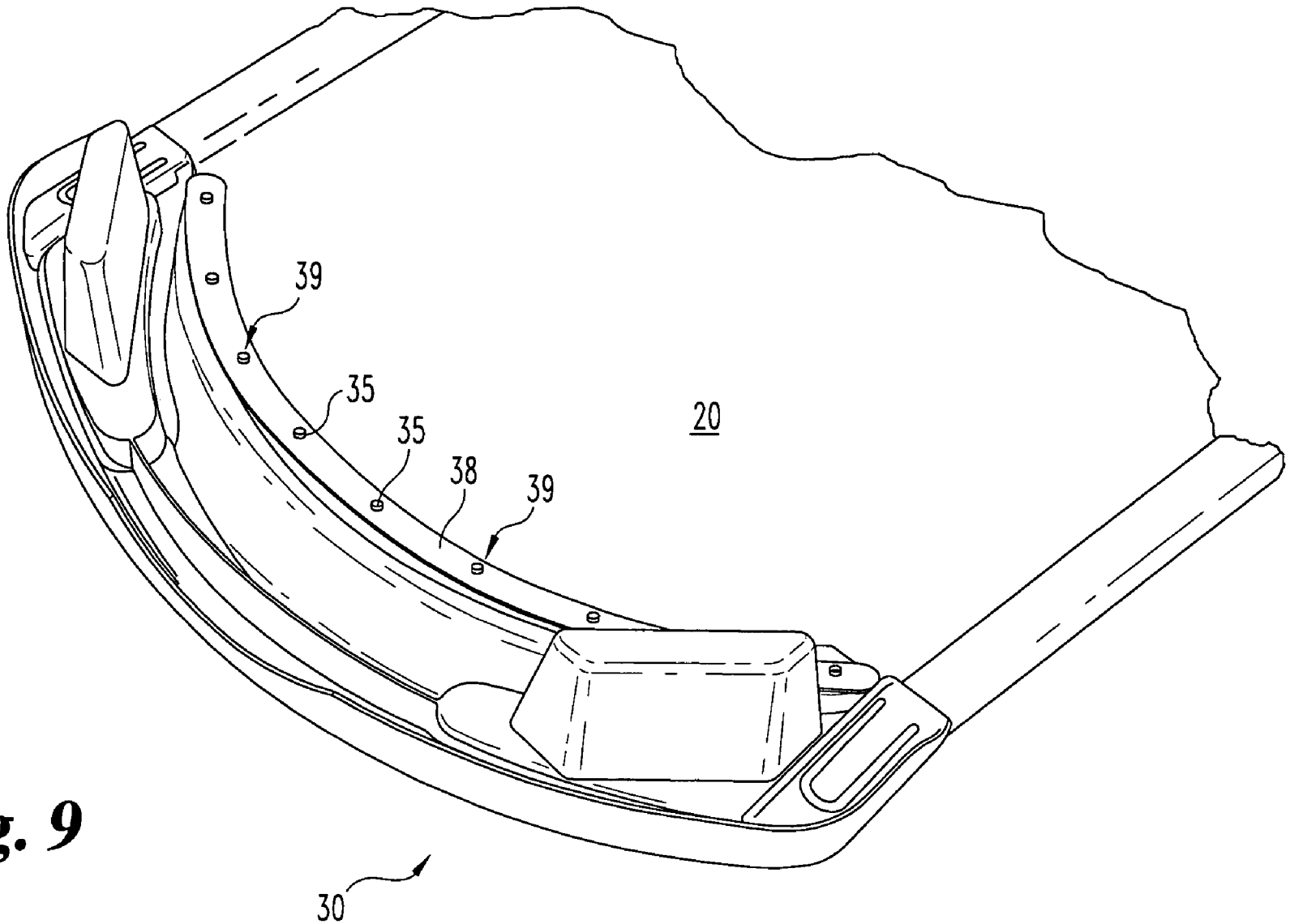
Figure 10:
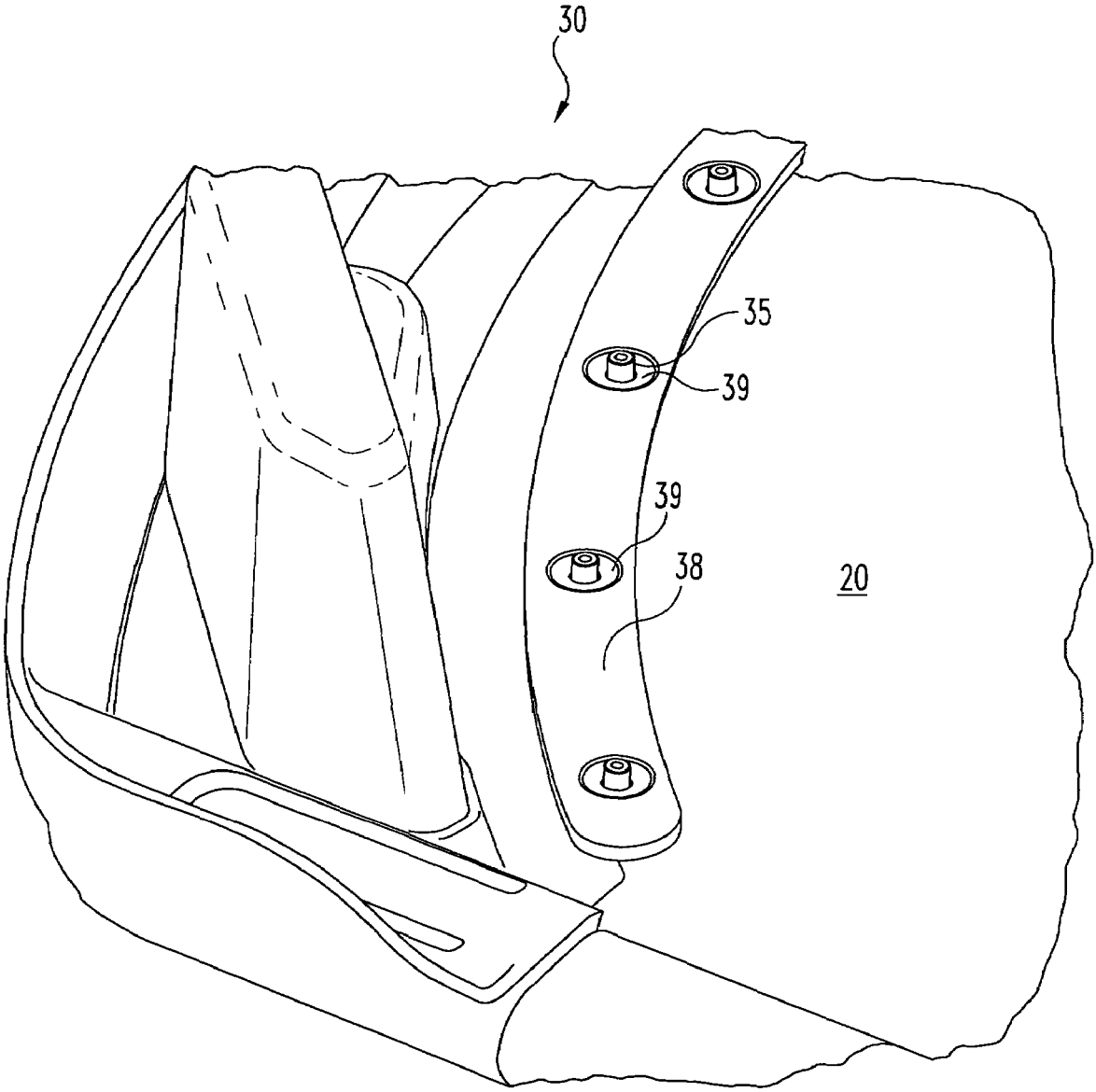
Figure 11B:
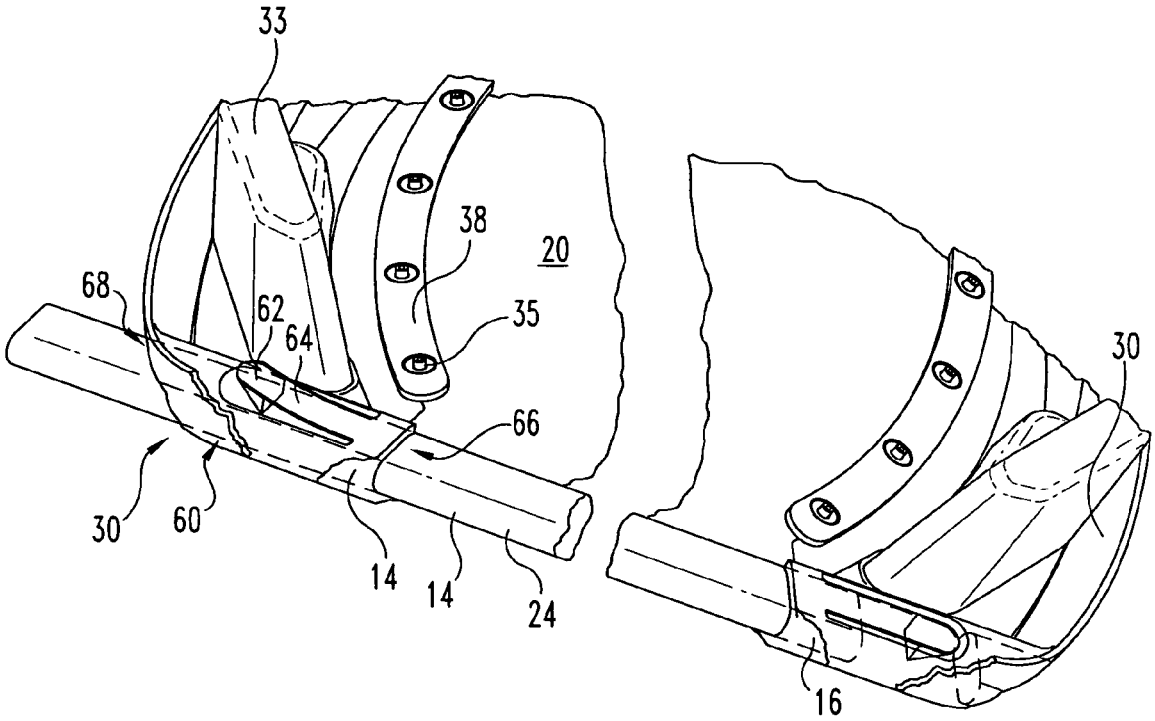
FIGS. 11B-D illustrate an end piece and side piece assembly method for the cot of FIG. 1.
Figure 11C:
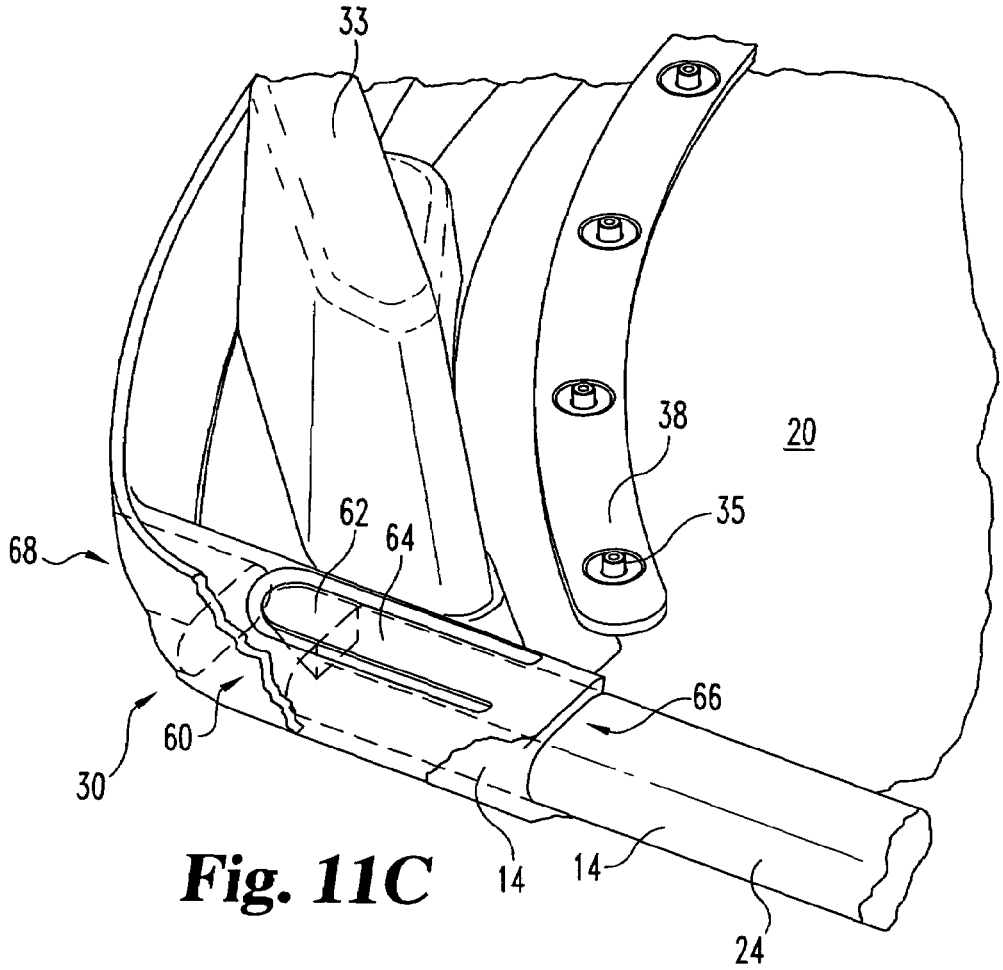
Figure 11D:
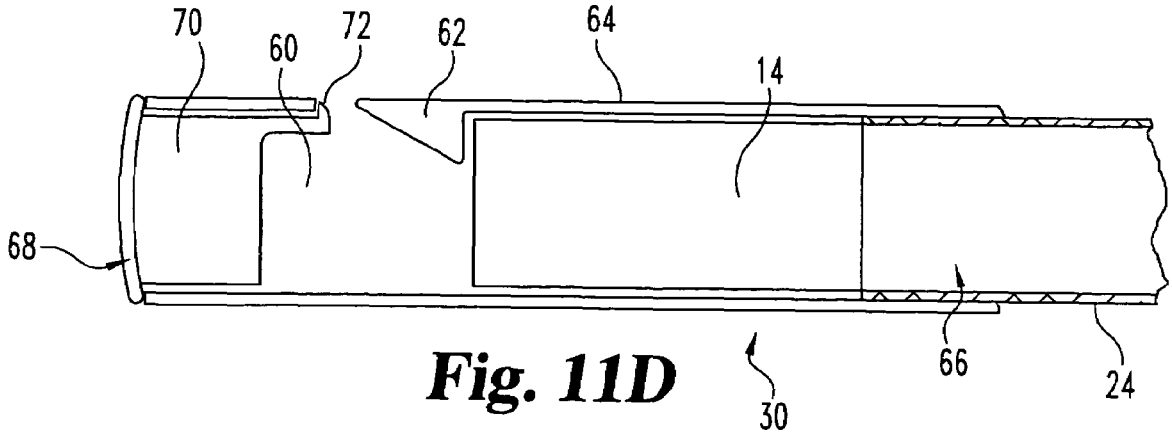

FIGS. 6, 10 and 11A-11D, illustrate one method of assembling the cot. In a preferred embodiment, no tools or fasteners are required. In summary, the bedding material 20 is attached or engaged to each end piece 30 (FIGS. 6-10). Side pieces 14 (FIG. 11A) are placed through channels in the end pieces 30 and side sleeves 24 (FIGS. 11B-11D). The side piece ends engage the end pieces, pushing and holding them apart a desired spaced apart distance. Preferably, side pieces 14 provide extension tension on material 20 between the end pieces, while material 20 provides a counteracting retraction force.

Figure 7:
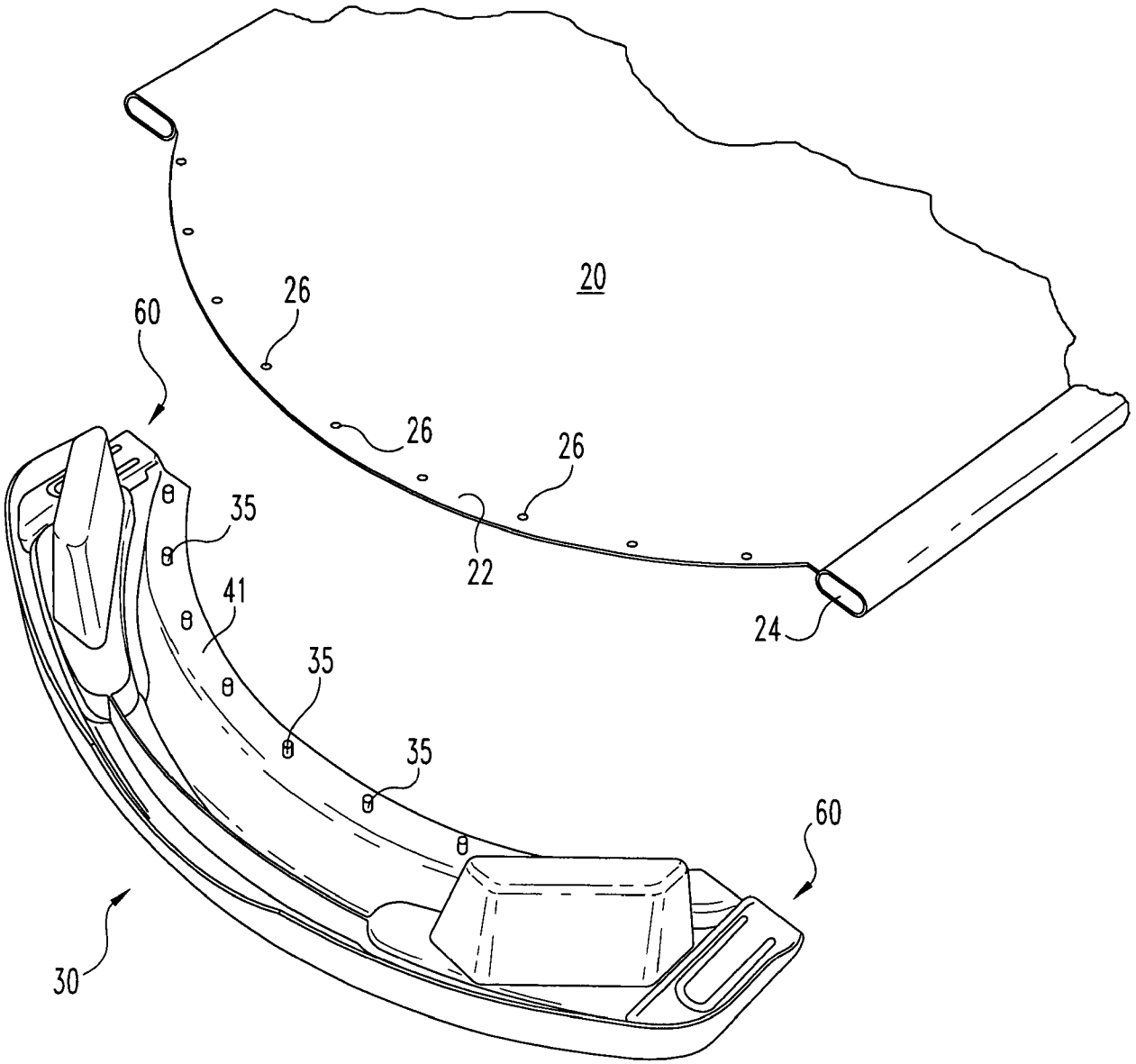
Figure 8:
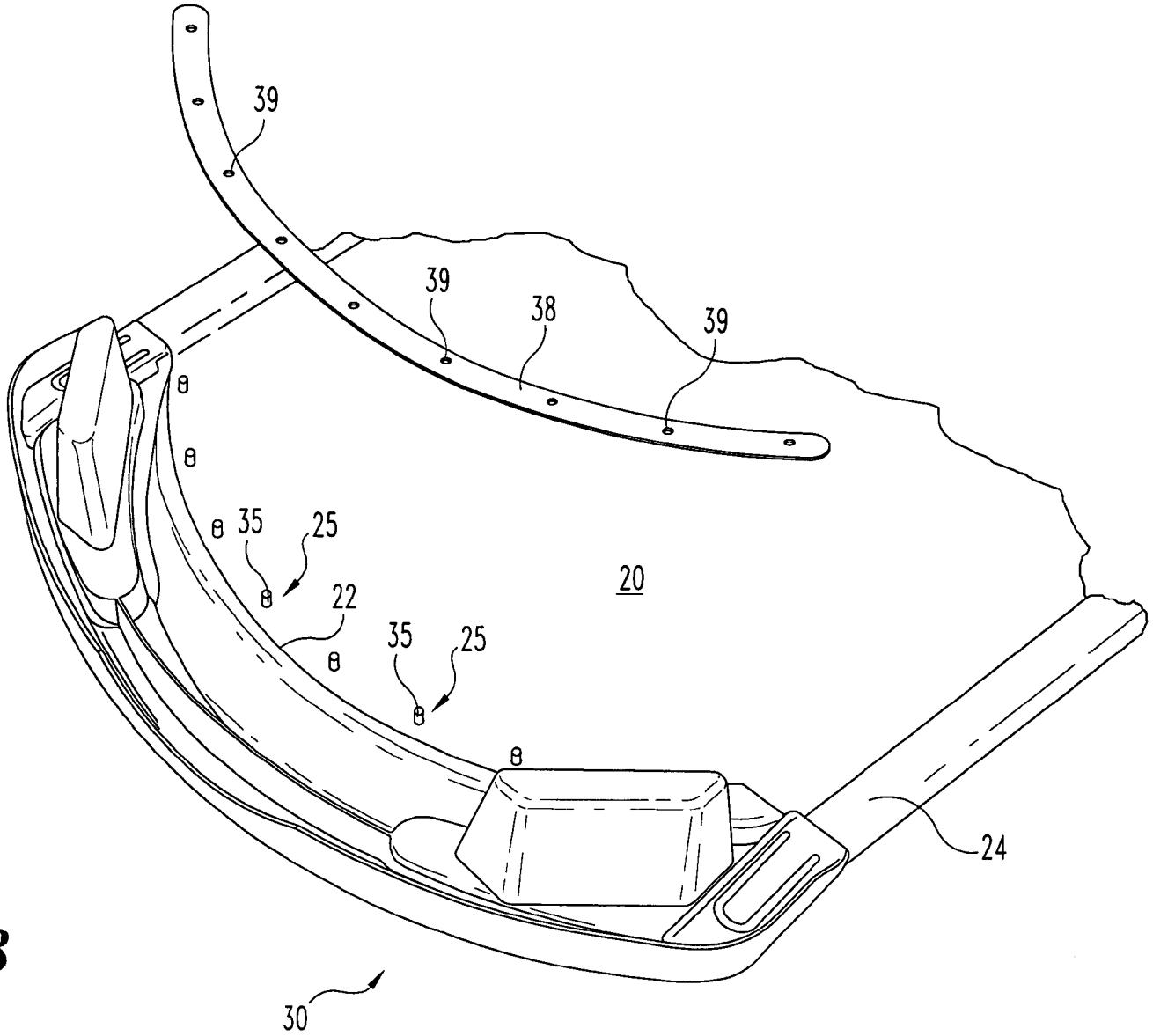

The bedding material end is connected to an end piece, optionally by a user, but preferable before shipping. An end piece 30 is shown upside down in FIG. 6, the opposing end piece is symmetric. End piece 30 includes protruding stakes 35 along the inner edge portion 41 (for example, nine stakes are shown). Molding piece 38 and end piece inner edge 41 form a slot along the inner edge 41 which receives bedding material 20. For assembly to an end piece, fabric or bedding material 20, having eye holes 25 along an end edge portion 22, is aligned with and placed over protruding stakes 35 (FIGS. 7-8). Preferably end edge portion 22 is laid in a continuous and even manner over at least a portion of end piece inner edge portion 41. The interior end edge 22 of material 20 is preferably heat sealed to prevent tears or unraveling. Optional sleeves 24 are aligned with channels 60.

In one method of assembly, molding piece 38, having stake holes 39, is aligned and placed over stakes 35, over the end edge portion 22 of material 20 and eye holes 25, so that stakes 35 extend all or partially through stake holes 39 and molding piece 38 (FIGS. 9-10). The ends of stakes 35 are then heated and melted or otherwise deformed to form a plug to lock molding piece 38 in place and thus retain material 20. Preferably this method of construction permanently connects material 20 to each end piece 30.

In the preferred embodiment shown, stakes 35 are plastic and are formed integrally with end pieces 30. Alternately, less preferred connectors, such as rivets, bolts and nuts, clips or screws, could be used. Deformation for this purpose includes for example, heat, mechanical pressure or a fastener such as a nut or clip which locks molding piece 38 in place.

In one preferred assembly version, the cot permits the side pieces 14 (FIG. 1A) to be inserted at a time after the material and end pieces have been assembled. As shown in FIGS. 11B-D with a cot end upside-down, when desired, at least one or two side frame pieces 14 are introduced between two end pieces 30. A distal end 16 of a side frame piece 14 is fed into an exterior opening 68 of a channel 60 in a near end piece 30, under the slanted exterior side of tang 62, which resiliently bends away upward on tongue 64. The distal end 16 is then pushed through a material sleeve 24 until the distal end engages the opposite end piece. The proximal end 15 of the side frame piece is advanced through channel 60, preferably putting a slight tension on fabric 20, until the proximal end 15 passes retaining tang 62, which then springs back into position, locking and retaining side piece 14 from retracting in an exterior direction through channel 60 (FIG. 11D). Preferably side piece 14 holds two end pieces 30 a desired spaced apart distance, and prevents the end pieces from approaching each other, while bedding material 20 prevents the end pieces from substantially exceeding the desired distance.

In one preferred embodiment, the second end piece is symmetric to the first end piece and engages distal end 16 with a similar channel and retaining tang. Alternately, the second end piece functions to engage and retain proximal end 16 in a different manner, for example, a closed opening to receive the end or a protruding portion which enters an opening in the end of the side piece.

In a preferred feature, a plug 70 (FIG. 11D) is used to close channel exterior opening 68 after the cot is assembled. Plug 70 may include a retaining tang 72, which can engage an opening in the bottom of piece 30 or a detent area. Plug 70 may assist to hold the side frame piece in place, and closes a potential finger opening for safety. Plug 70 may be flush with the end piece opening, may be inset, or may protrude slightly.

In a further preferred feature, no fasteners such as screws, bolts, nuts, etc. are involved in the side piece to end piece assembly. This removes the risk of the fasteners becoming disassembled or small pieces providing a swallowing hazard for children.

If there is a desire to partially disassemble cot 10, in certain embodiments plug 70 may be removed, if present, and the retaining tang 62 pulled outward to release and allow a side piece 14 to be slidably removed in an exterior direction through channel 60. In this manner of release, end pieces 30 move towards each other to disengage the side piece. A tool may be needed to easily pull tang 62 out of the way or optionally a handle or grip may be molded in.

Figure 12:
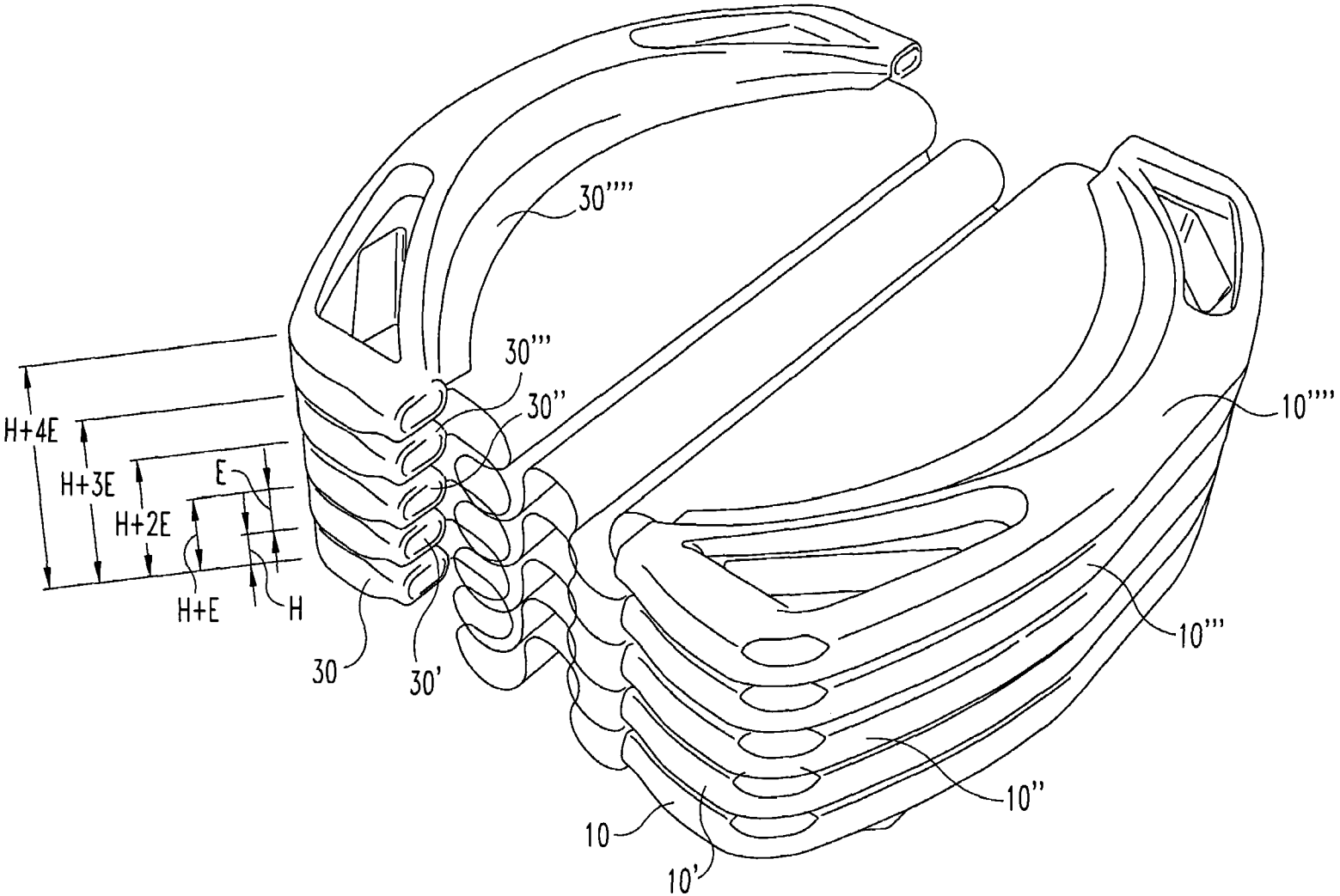
FIG. 12 is a perspective view of a stack of cot partial assemblies.

Referring to FIG. 12, each of the end pieces 30 defines at least one support, such as a pedestal and pocket that allows a plurality of cots 10 or end pieces to be nestably stacked one upon another. Preferably, the inner walls of the pocket define a shape to slidably and removably receive the pedestal of a second end piece placed on top of the first end piece with the outer surface of the received pedestal in close or abutting contact with the inner walls of the pocket. In one option, the pedestals are sized and configured to permit stackability with other cot designs, such as the cot described in U.S. Pat. No. 5,003,649, incorporated herein by reference.

In the preferred embodiment, pedestal 33 of each end piece 30 extends downwardly from within the interior area of the cot in an area not covered by bedding material. This allows the pedestals to be located within the interior periphery of end pieces 30 and side pieces 14 without bedding material 20 overlapping pedestal 33 or pocket 31 to interfere with stacking. Preferably the top surface of each end piece has a profile to mate with the bottom surface of an end piece placed above it.

The simplicity of the preferred embodiment shown allows the frame to be mounted to low profile end pieces at a height independent of the height of the pedestal. Since the pedestal/pocket passes between the frame and the bedding material, the top of the pedestal can be lower than, equal to or higher than the level of the bedding material. In the preferred embodiment illustrated, the level of the bedding material H is substantially equal with the top of the pedestal (see FIG. 5B).

FIG. 12 illustrates a nested stack of partial cot assemblies, shown in a manner for compact shipping, packaging, or storing. Each cot assembly 10, 10', 10", 10''', and 10'''' includes end pieces 30, 30', 30", 30''' and 30'''' with pedestals and pockets (sleeves of the cots are not shown). At least a portion of the height of a pedestal of each cot assembly is received in the corresponding pocket of the cot below. Each cot assembly has a height (for example $H_c$ in FIG. 3), however, the stacked height of cots 10, 10', 10", 10''' and 10'''' is less than the sum of the heights H of the individual cots. Preferably, the interface between the inner walls of the pockets and the received pedestal is such that a plurality of cots may be easily stacked and unstacked with minimum exertion or effort. Further, the fit is desirably close enough that it provides stability to a stack of cots.

The first cot height H is the only height which cannot be nested. The cots are configured for stacking and nesting to a point where each additional cot adds only an end piece height E to the stack. A rounded rectangular cross-section in the side frame members may assist in reducing cot stack separation. As illustrated in FIG. 12, preferably the height of five nested cot assemblies is the height of the first cot assembly H plus the end piece height E of the four stacked cot assemblies. (Total height=H+4E). A greater or lesser number of cots may be used as desired.

In one arrangement, a plurality of end pieces is formed in two stacks, wherein each end piece in the first stack is attached to a corresponding end piece in the second stack via a piece of bedding material. The stacks may be arranged substantially adjacent each other for shipping or storage, with the bedding material arranged loosely, for example, rolled, folded and/or bunched, at least partially between the stacks.

Figure 13:
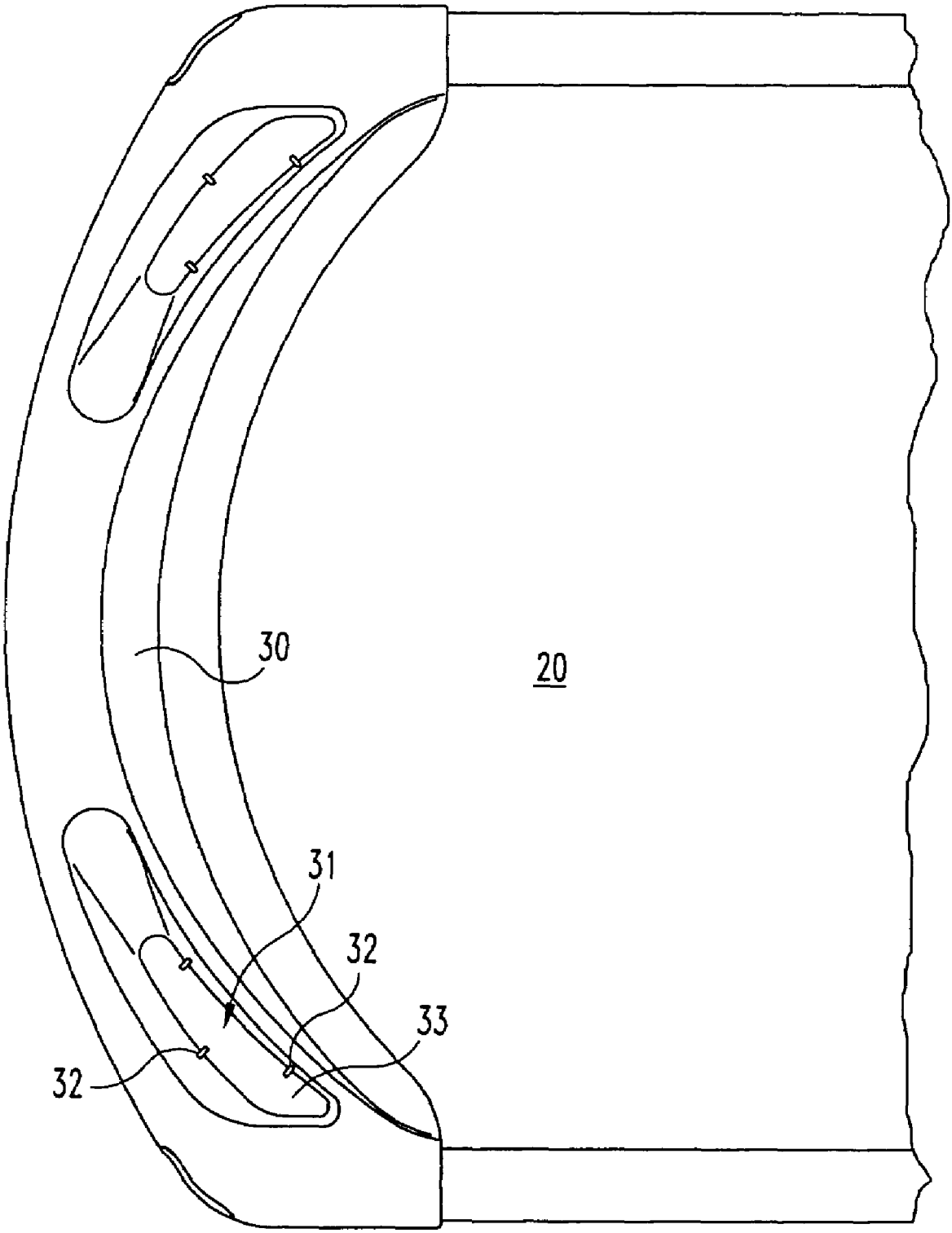
FIGS. 13-14 are top, plan and bottom plan views of one end of a cot assembly.
Figure 14:
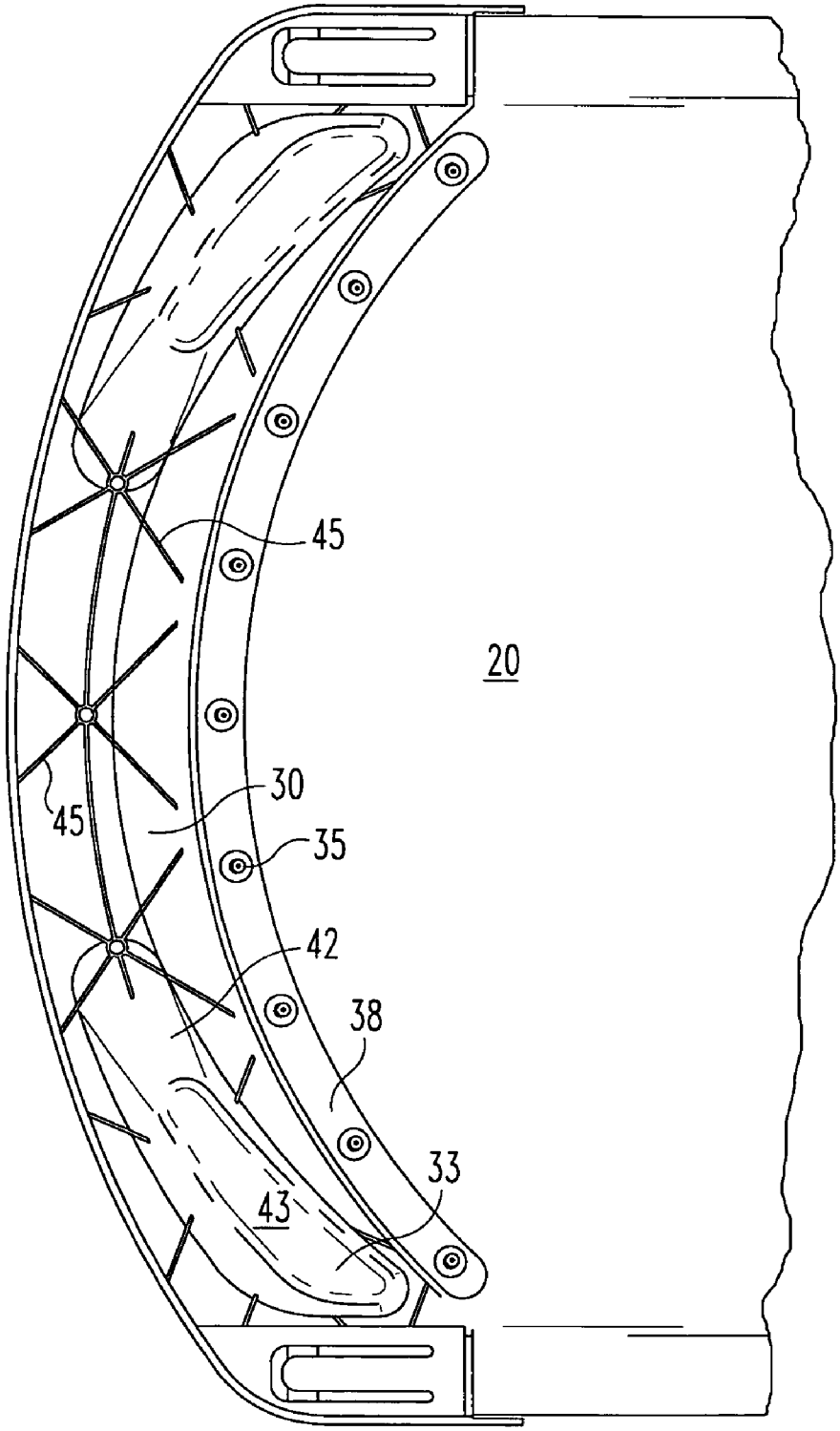

Shown in FIGS. 13 and 14, each cot end piece may include pocket braces 32 or end piece cross-braces 45 for strength. Pocket braces 32 within each pedestal also serve to limit the nesting distance to prevent jamming between nested pedestals. This improved nesting relationship allows a larger number of cots to be stacked within the same height or the same number of cots has a lower profile.

Figure 15:
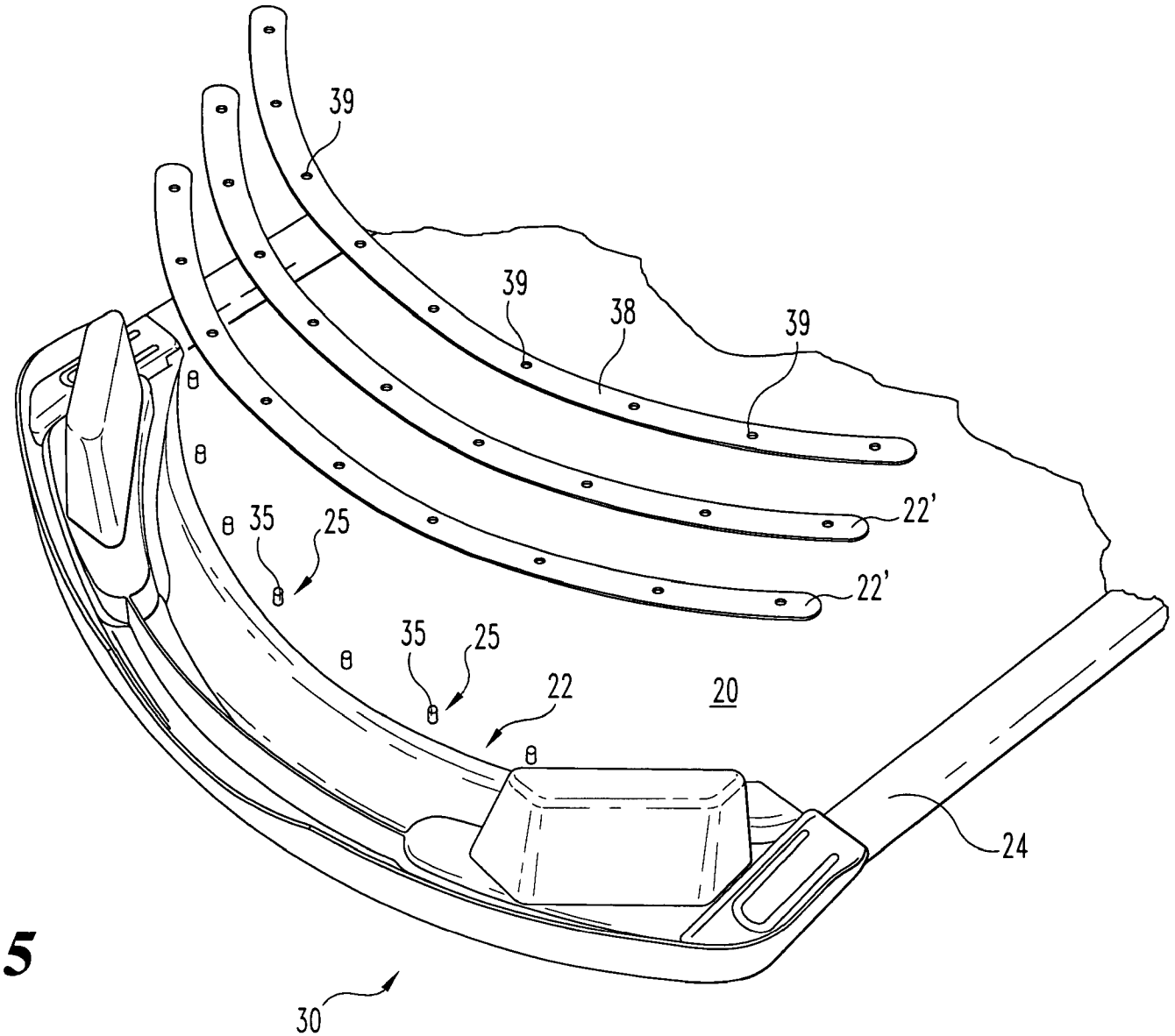
FIG. 15 illustrates an alternate material to end piece assembly method.

An optional assembly and method is illustrated in FIG. 15. An end edge 22 of bedding material 20 may be reinforced during attachment to an end piece to provide a greater thickness to increase the strength of the fabric in order to resist pulling or tearing of eyeholes 25 from stakes 25 through inward pulling encountered during use of the cot. In one embodiment, one or more reinforcing strips 22' of bedding material are layered over the end edge 22 of the fabric. The strips 22' can be layered above or below end edge 22 or can sandwich end edge 22 in a middle layer. For one preferred example, two strips 22' can be formed of the same shape and material as the end edge and stacked over end edge 22 between the end piece 30 and the molded piece 38. The strips can be separate or connected by adhesive, lamination, plastic molding or other known methods.

In an alternate embodiment, end edge 22 of fabric 20 may be injection molded to continuously integrate the end edge with a plastic material impregnated in and reinforcing end edge 22. The end edge and plastic molding can be made, for example, using the method disclosed in application Ser. No. 60/541,133, filed on Feb. 2, 2004 entitled METHOD OF MANUFACTURE USING FABRIC IN INJECTION MOLDING, and hereby incorporated herein by reference. A plastic molded fabric end under this embodiment can be placed over stakes 35 of end piece 30 and can be locked in place with or without molding piece 38. A plastic molded end can be connected in other manners, such as a slot or fastener which receives and retains the molded end portion.

Figure 16:
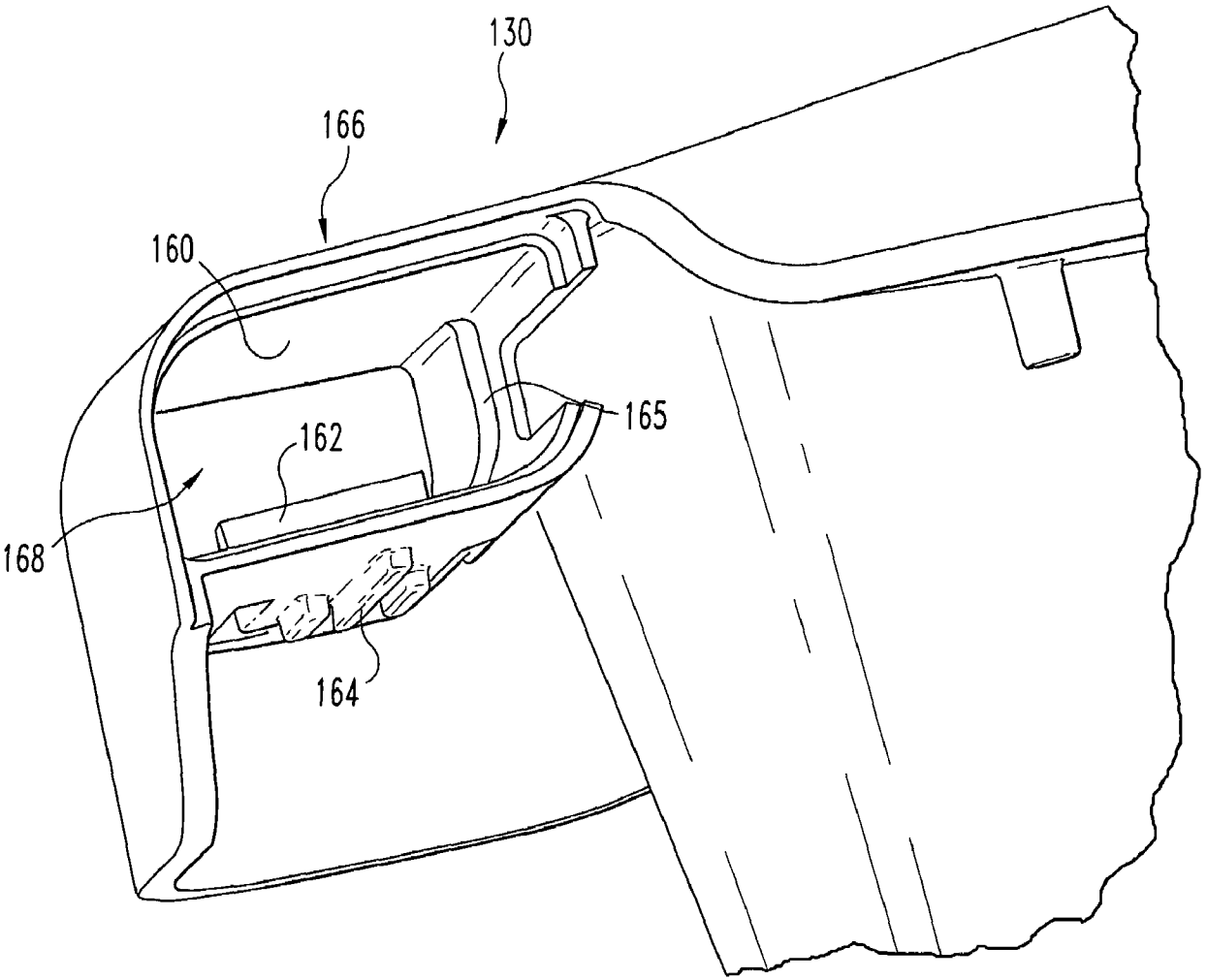
FIGS. 16-18 illustrate views of an alternate end piece, with FIG. 17 being a cross-sectional view.
Figure 17:
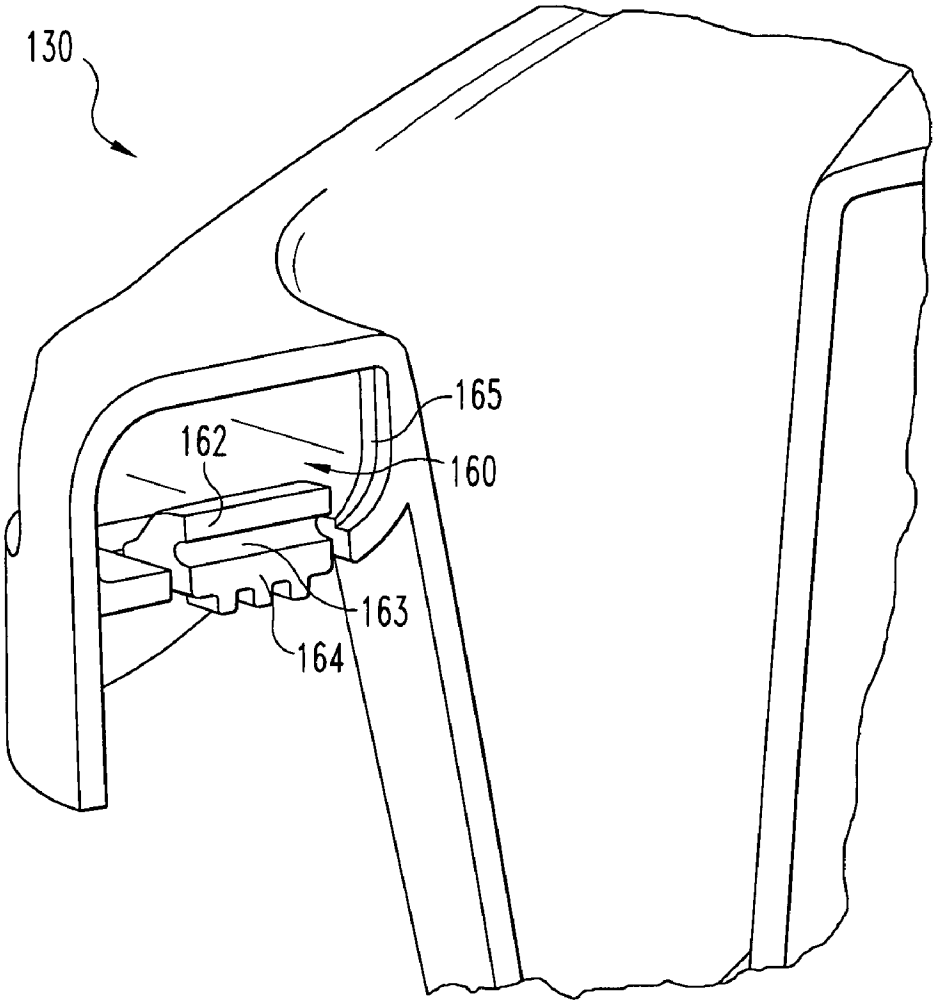
Figure 18:
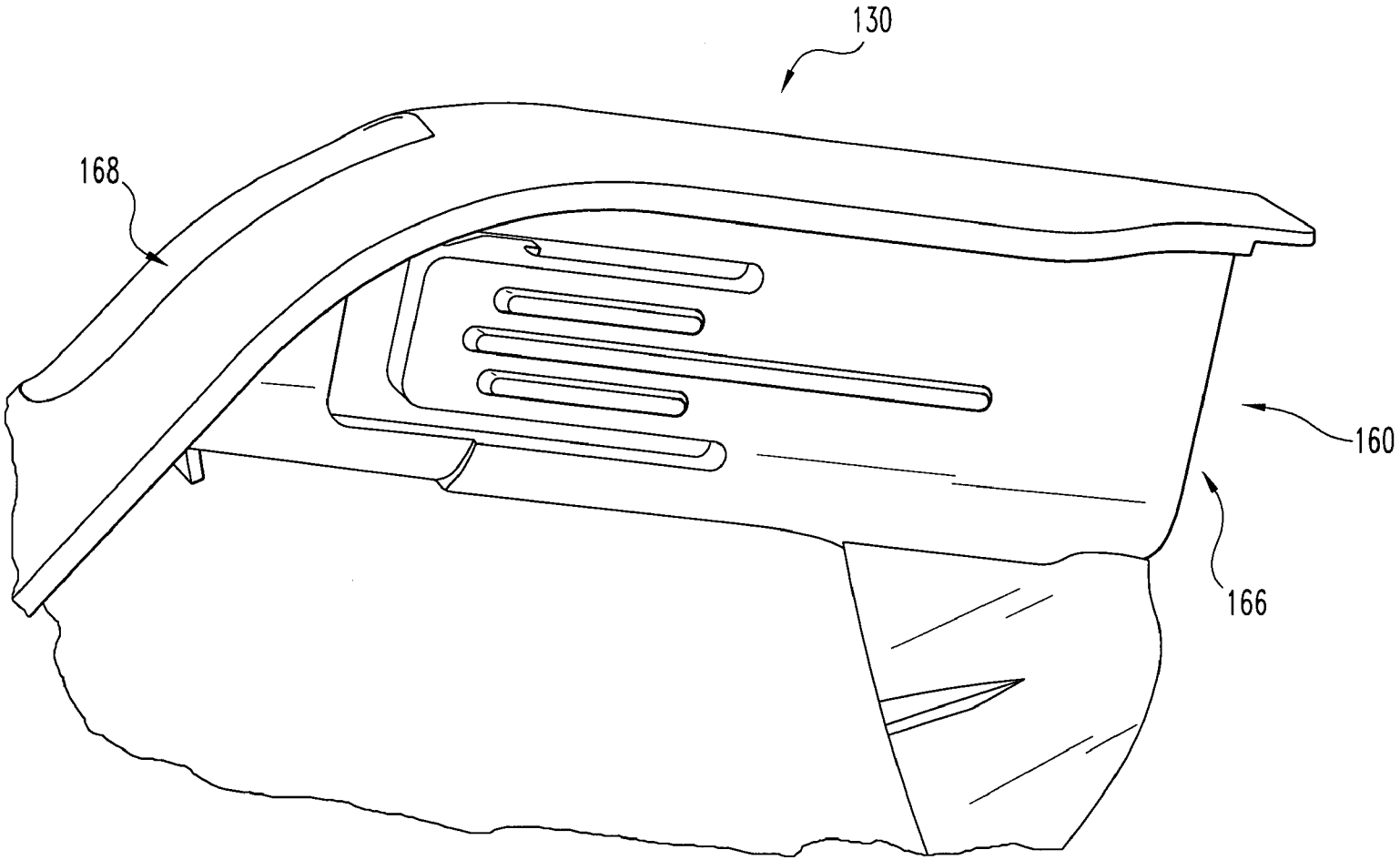

An alternate preferred version of an end piece 130 is shown in partial views in FIGS. 16-18. End piece 130, as is end piece 30 above, is configured to allow an end of a side frame piece 14 to be fed into an exterior opening 168 of a channel 160, over a slanted exterior facing side of tang 162, which resiliently bends away on tongue 164. The side piece is pushed through a material sleeve (not shown) and the distal end engages the opposite end piece. The proximal end of the side piece is pushed through channel 160, preferably putting a slight tension on bedding material 20, until the proximal end passes retaining tang 162, which then springs back into position, locking side piece 14 from retracting through channel 160. A cross-sectional view of end piece 130 and channel 160 is shown in FIG. 17. Optionally, tang 162 may include a groove 163 for engaging and receiving the end edge of the side piece.

Preferably, the width between two side channels 160 in end piece 130 and the corresponding width between two side pieces 14 is slightly greater than the fabric or bedding material width, such that when assembled, the bedding material places a slight inner and sideways tension on the side pieces, pulling the side pieces 14 towards the center of the end piece and the cot. Preferably this tension pulls the end of one or both side pieces 14 towards the inner side of channel 160, against and engaging a shoulder or shelf 165 in channel 160. Optionally, shoulder 165 is aligned with tang 162 at a predetermined distance in channel 160 to separately or in cooperation retain the end of the side piece from moving outward through channel 160 (shown in cross-section in FIG. 17). When the cot is to be disassembled, the side piece is moved toward the outer edge of channel 160 to disengage the end from shoulder 165 before the side piece is removed. For example purposes, shoulder 165 can have a depth in the range of 0.060"-0.125", with one preferred depth of 0.060 inches.

Figure 19:
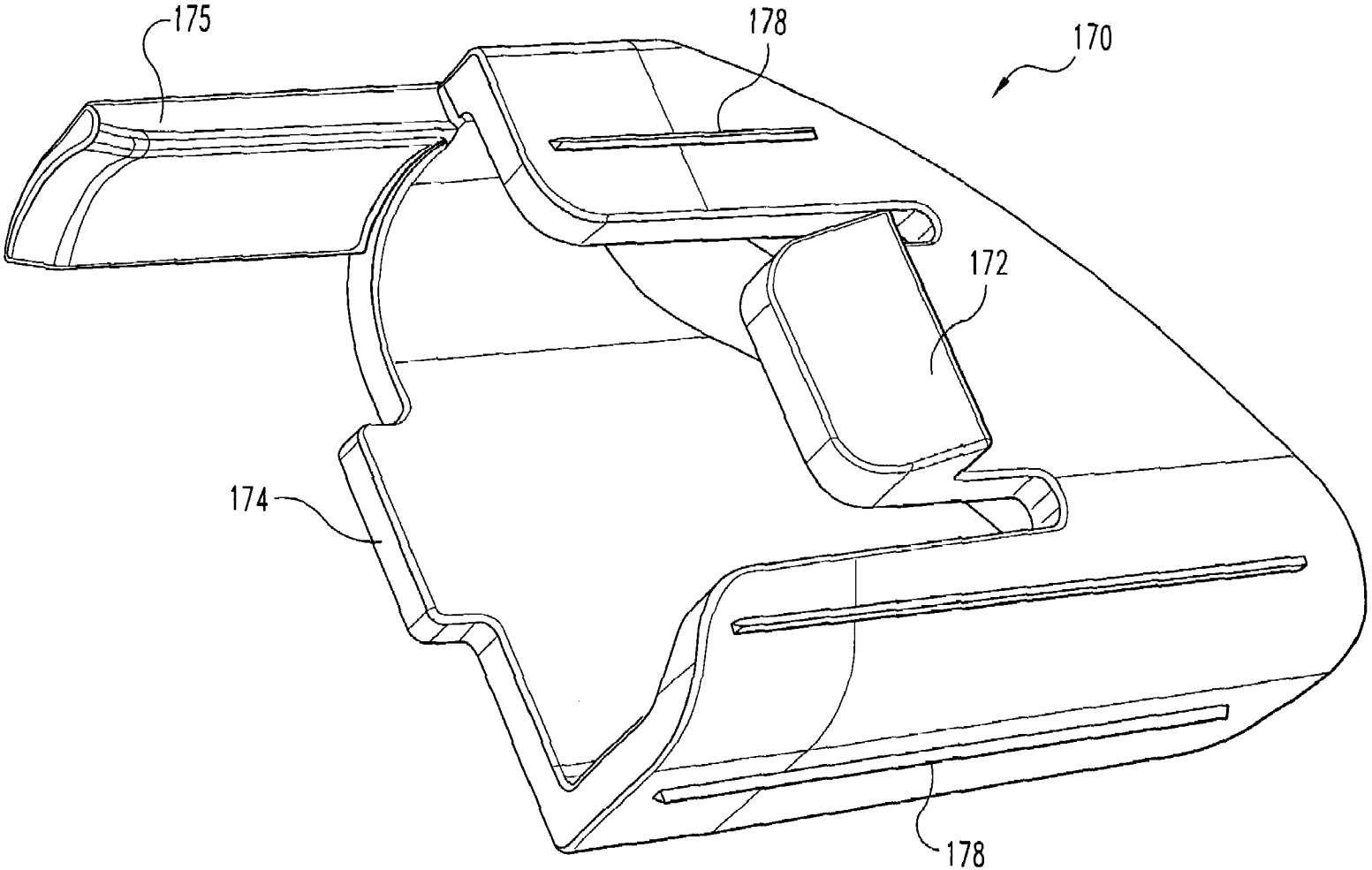
FIGS. 19-21 illustrate views of an alternate plug usable with the end piece of FIGS. 16-18.
Figure 20:
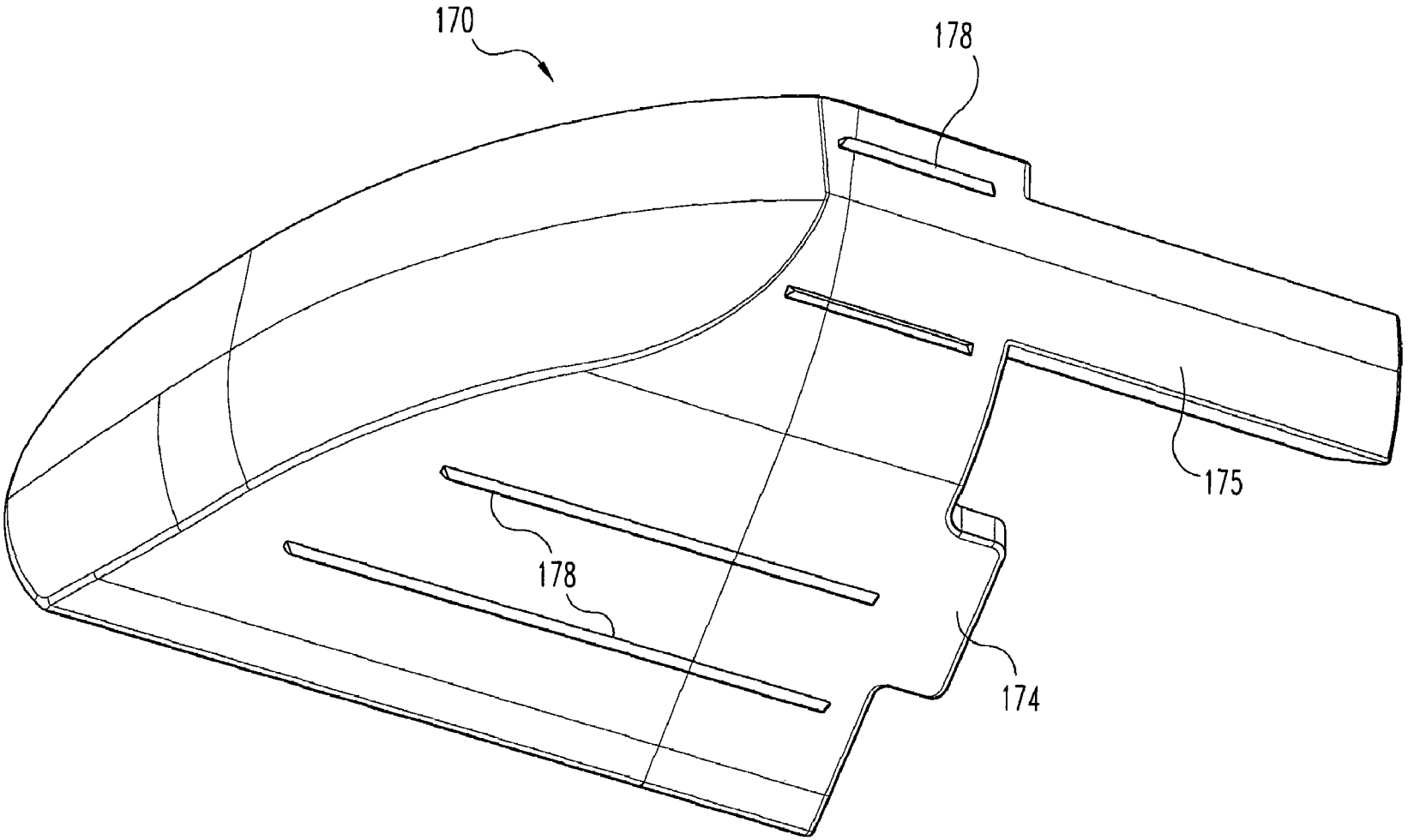
Figure 21:
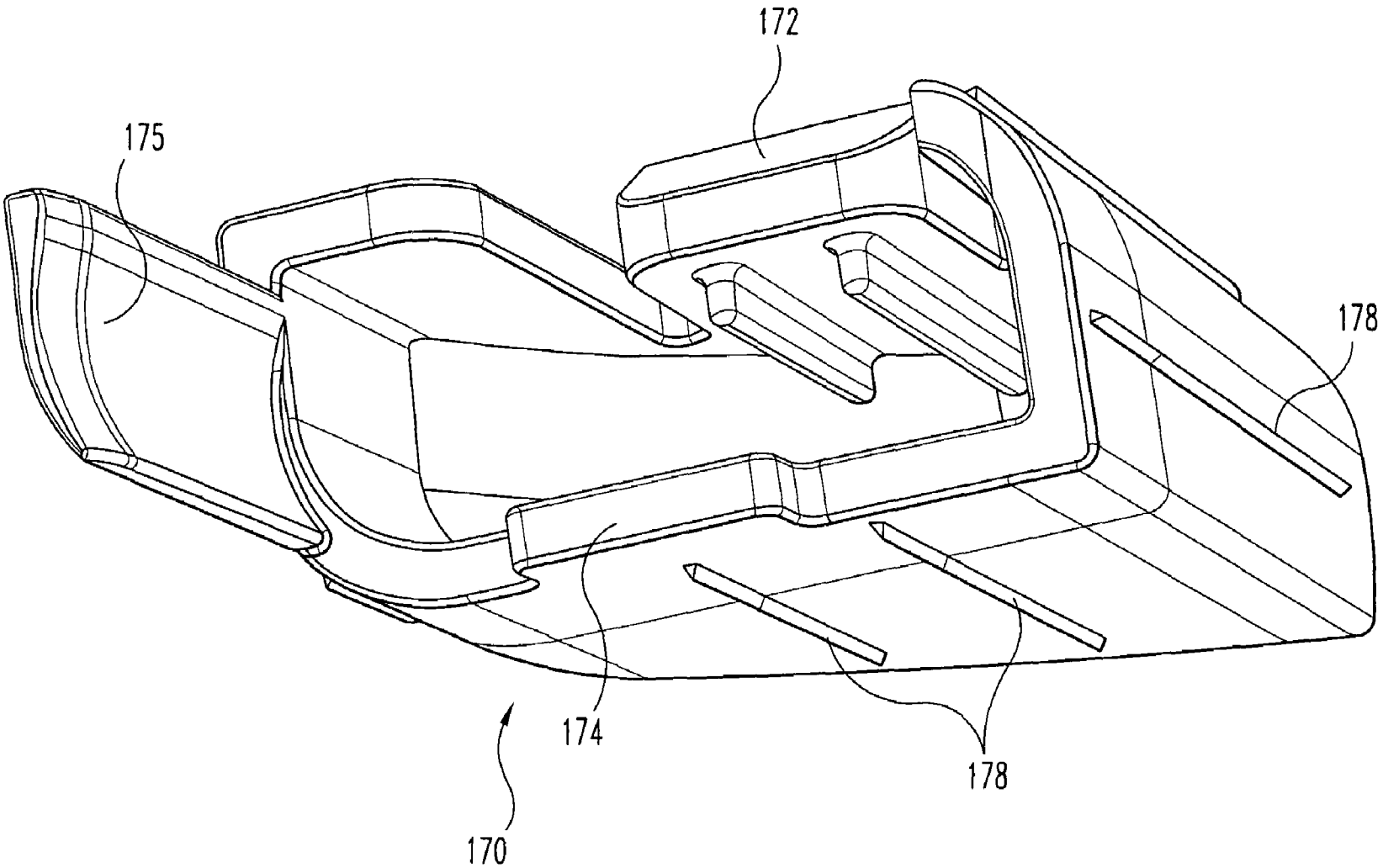

An alternate plug 170 is illustrated in FIGS. 19-21. Plug 170 preferably is used to close end 168 in end piece 130 after the cot is assembled. Plug 170 may include a retaining tang 172, which can engage an opening in end piece 130 or a detent area to retain plug 170 in place. Plug 170 also preferably includes an extending wedge portion 175. Wedge portion 175 extends inward from the plug 170, and is sized to fit between a side piece 14 and the outer wall of channel 160. Wedge portion 175 preferably assists in pushing the end of side piece 14 towards the inner side of channel 160 and into engagement with shoulder 165. Wedge portion 175 preferably matches the profile of the outer side of channel 160 and the outer side of the end of side piece 14.

As an optional feature, plug 170 may include an inner end tab 174, which abuts tang 162 when plug 170 is placed in end piece 130. Tab 174 preferably locks or impedes tang 162, groove 163 and tongue 164 from moving away from the end piece or disengaging unintentionally.

Separately, plug 170 may optionally include protruding ribs 178, spaced apart and extending slightly outward from the plug body. As an example, the ribs may have a height of 0.020 inches. Ribs 178 are preferably slightly larger than the size of channel 160 so that the ribs engage the channel walls when the plug is inserted. Optionally, ribs 178 can be compressed or crushed as the plug is placed in the end piece. Preferably plug 170 is restrained from being removed or falling out accidentally or unintentionally, but can be removed from end piece 130 during disassembly of the cot. The outer end of plug 170 may be flush with the end piece opening or may be recessed or protrude slightly.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A cot assembly kit, comprising:

a. a bedding material having at least two ends;

b. at least two end pieces pre-connected to said at least two ends;

c. wherein said bedding material and said end pieces define interior directions towards a center of said bedding material from said ends, and define opposite exterior directions from the center of said bedding material towards said end pieces;

d. wherein at least one of said end pieces has a substantially straight channel defining a longitudinal axis and wherein said channel defines an inner opening on an inward side adjacent said bedding material and defines an opposing exterior opening on an outward side opposite said bedding material, wherein said channel defines an interior direction towards the center of the assembled cot assembly and defines an exterior direction opposite to said interior direction and away from the center of the assembled cot assembly;

e. at least one side piece defining a longitudinal axis parallel to the longitudinal axis of said channel, said at least one side piece having a distal end portion and a proximal end portion, wherein said distal end portion engages one of said end pieces, and wherein the other of said at least two end pieces allows said proximal end portion to be advanced at least partially through said channel, and wherein said channel is configured to selectively retain said proximal end portion from moving through said channel in an exterior direction through said exterior opening and to selectively allow said proximal end portion to move through said exterior opening in an exterior direction; and f. wherein said channel is configured to engage said proximal end portion after advancement of said proximal end portion a predetermined distance through said channel; and, wherein said channel includes a biased tang for resiliently engaging said proximal end portion.

2. The cot assembly kit of claim 1, further comprising a plug having a cross-section substantially matching the cross-section of said exterior opening to seal the exterior opening of said channel.

3. The cot assembly kit of claim 2, wherein said plug is configured to inhibit said retaining tang from disengaging from said proximal end portion.

4. The cot assembly kit of claim 2, wherein said plug is configured to be retained in said channel.

5. The cot assembly kit of claim 1, comprising at least a second side piece having a distal end portion and a proximal end portion, wherein said distal end portion is configured to engage one end piece, and wherein the other of said at least two end pieces defines a second channel, wherein said second side piece proximal end portion is advancable at least partially through said second channel, and wherein said second channel is configured to selectively retain said second side piece proximal end portion from retracting in an exterior direction through said second channel.

6. The cot assembly kit of claim 5, wherein said bedding material includes sides having sleeves to encompass the length of said side pieces between said end pieces.

7. The cot assembly kit of claim 6, wherein said bedding material has a width and said first and second channels are arranging on opposing sides of said bedding material, and wherein said channels are spaced apart a distance slightly greater than the width of said bedding material such that said bedding material is sized to apply an inward tension to said side pieces in said channels.

8. A cot assembly, comprising:

a. a bedding material having at least two ends;

b. at least two end pieces connected to said at least two ends;

c. each end piece having at least one support for supporting said bedding material above a support surface;

d. at least two side pieces each side piece having a length defining a longitudinal axis, wherein each side piece is engaged between two said end pieces to hold the two end pieces at least a desired spaced apart distance, and wherein said bedding material prevents said end pieces from being spaced apart a distance substantially exceeding said desired distance; and, e. wherein at least one of said end pieces is configured to selectively release at least one of said side pieces by allowing one end piece to move towards the other end piece;

f. wherein at least one of said end pieces has a substantially straight channel having a longitudinal axis parallel to the longitudinal axis of a side piece, said channel having two ends defined through said end piece, wherein said channel defines an interior direction towards the center of the length of the assembled cot assembly and defines an exterior direction opposite to said interior direction and away from the center of the assembled cot assembly; with said channel having an interior open end defined in the interior of the cot assembly inside the periphery of said end pieces and side pieces, and an exterior open end defined on the exterior of the cot assembly, wherein said channel slidably receives a side piece, wherein said channel selectively retains a portion of said side piece from moving through said exterior open end in said exterior direction; and wherein said channel includes a selectively engagable retaining tang to retain a portion of said side piece from moving in said exterior direction through said channel.

9. The cot assembly of claim 8, wherein said retaining tang defines a groove for engaging said side piece.

10. The cot assembly of claim 8, wherein said retaining tang is resiliently biased to remain in a retaining orientation.

11. The cot assembly of claim 10, wherein said channel defines an interior direction opposite to said exterior direction, and wherein said retaining tang allows said side piece to move in said interior direction through said channel.

12. The cot assembly of claim 8, wherein said channel is defined by a top wall, a bottom wall and two opposing side walls, with one side wall being on an inward side towards the center of said end piece, and wherein said channel includes a shelf defined on said inward side wall to selectively retain a side piece portion from moving in the exterior direction through said channel.

13. The cot assembly of claim 12, further comprising a plug having a cross-section substantially matching the cross-section of said exterior open end and configured to seal said exterior open end.

14. The cot assembly of claim 13, wherein said plug has a retaining tang to retain said plug in sealing engagement with said channel.

15. The cot assembly of claim 13, wherein said plug includes a wedge portion extending between said side piece portion retained by said shelf and the outer side of said channel.

16. The cot assembly of claim 15, wherein said wedge portion has an inner profile matching the profile of said side piece portion, and an outer profile matching the profile of said outer side of said channel.

17. The cot assembly of claim 14, wherein said plug inhibits said retaining tang from disengaging.

18. The cot assembly of claim 8, wherein said at least one end piece support includes at least one pedestal extending downwardly to raise the bedding material above an external support service.

19. The cot assembly of claim 18, wherein each said end piece support includes a pocket defined within said pedestal, wherein said pocket is configured for nestably receiving a pedestal of a second cot assembly.

20. The cot assembly of claim 8, wherein at least one end piece has an inner edge portion towards the interior of said cot, and wherein one of said bedding material ends is continuously engaged to said end piece along said inner edge portion.

21. The cot assembly of claim 20, wherein said engaged bedding material end extends into a slot defined along said inner edge portion of said end piece.

22. The cot assembly of claim 21, wherein said end pieces are made of plastic.

23. The cot assembly of claim 22, wherein said slot includes an end piece upper portion arranged on one side of the bedding material end and a molding piece arranged on the side of the bedding material end opposite said upper portion and secured to said end piece.

24. The cot assembly of claim 23, wherein one of said upper portion and said molding piece include protruding plastic stakes extending through eye holes in the bedding material end and received in stake holes in the other of said upper portion and said molding piece, and wherein said stakes are deformed to prevent disengagement of said molding piece from said end piece.

25. The cot assembly of claim 20, wherein the bedding material end is impregnated with a molded plastic material, and wherein said bedding material end is attached to said inner edge portion of said end piece.

26. The cot assembly of claim 25, wherein said impregnated bedding material end defines eye holes which receive plastic stakes protruding from said end piece and wherein said stakes are deformed to prevent disengagement of said molding piece from said end piece.

27. The cot assembly of claim 8, wherein said cot assembly has a substantially rectangular cross-section.

28. The cot assembly of claim 27, wherein said side pieces have a non- circular cross-section.

29. The cot assembly of claim 28, wherein said side pieces have a substantially rectangular cross-section.

30. A method of assembling a cot, comprising:

a. providing a bedding material having at least two ends and having at least two end pieces connected to said at least two ends and defining a bedding material length between them wherein said bedding material defines an interior direction towards the center of the bedding material length and defines an exterior direction opposite to said interior direction and away from the center of the bedding material;

b. engaging one end piece with a distal end portion of a side piece;

c. advancing a proximal end portion of said elongate side piece through a channel in a different one of said end pieces wherein said proximal end portion advances in an interior direction relative to said end piece through an exterior opening to said channel defined on an exterior face of said end piece;

d. retaining said proximal end portion from retracting through said exterior openings to said channel such that said side piece holds said end pieces a desired spaced apart distance, and wherein said bedding material prevents the distance between the end pieces from substantially exceeding the desired spaced apart distance; and, e. wedging said proximal end portion against a retaining shelf on an inner side of said channel.

31. The method of claim 30, further comprising urging said proximal end portion against a retaining shelf on an inner side of said channel.

32. The method of claim 31, further comprising overlapping said side piece with said bedding material between said end pieces wherein said bedding material completely covers the interior area of said cot between said end pieces and said side pieces such that there are no gaps between said bedding material, said end pieces and said side pieces in which a part of a person's body may be received.

33. The method of claim 32, further comprising advancing said side piece through a sleeve along said bedding material length between said end pieces.

34. The method of claim 31, further comprising advancing two side pieces along opposing sides of said bedding material length between said end pieces and arranging said bedding material to provide an inward tension upon said side pieces.

35. A cot assembly, comprising:

a. a bedding material having at least two ends;

b. at least two end pieces connected to said at least two ends;

c. each end piece having at least one support for supporting said bedding material above a support surface;

d. at least two side pieces each side piece having a length defining a longitudinal axis, wherein each side piece is engaged between two said end pieces to hold the two end pieces at least a desired spaced apart distance, and wherein said bedding material prevents said end pieces from being spaced apart a distance substantially exceeding said desired distance; and, e. wherein at least one of said end pieces has a substantially straight channel having a longitudinal axis parallel to the longitudinal axis of a side piece, said channel having two ends defined through said end piece along said longitudinal axis, wherein said channel defines an interior direction towards the center of the length of the assembled cot assembly and defines an exterior direction opposite to said interior direction and away from the center of the assembled cot assembly; with said channel having an interior open end defined in the interior direction of the cot assembly inside a periphery of said end pieces and side pieces, and an exterior open end defined on the exterior direction of the cot assembly.

36. A method of engaging a cot bedding material to a frame piece, comprising:

a. providing a cot frame piece with an interior edge and configured to engage two parallel side pieces wherein said parallel side pieces are configured to engage an opposing end piece to form a substantially rigid cot perimeter;

b. providing a bedding material with an edge portion corresponding in width to said interior edge of said frame piece;

c. forming a plurality of eye holes through said bedding material edge portion;

d. laying said bedding material edge portion over at least a portion of said frame piece interior edge in a substantially continuous and even arrangement;

e. placing stakes associated with said frame piece through said eye holes defined in the bedding material edge portion;

f. locking said stakes to prevent removal of said bedding material eye holes from said stakes and to retain said bedding material edge portion on said frame piece; and, g. supporting said rigid perimeter and said bedding material above a support surface with at least one support surface engaging portion extending downward from said end piece.

37. The method of claim 36, wherein said stakes protrude from said frame piece edge.

38. The method of claim 36, comprising placing a molding piece with eye holes over said bedding material edge and said stakes, and sandwiching said bedding material between said frame piece and said molding piece before locking said stakes.

39. The method of claim 38, wherein said stakes are locked by deforming said stakes to prevent removal.

40. The method of claim 39, wherein said stakes are integrally formed with said frame piece.

41. The method of claim 39, wherein said stakes are formed of plastic.

42. The method of claim 39, wherein said stakes are deformed using heat.

43. The method of claim 39, wherein said stakes are formed separately from said frame piece.

44. The method of claim 39, wherein said stakes are deformed by mechanical pressure.

45. The method of claim 36, wherein said stakes protrude from one of said frame piece edge and a molding piece, and wherein said frame piece and said molding piece sandwich said bedding material before attaching said stakes by deformation, such that said stakes secure said frame piece to said molding piece.

46. The method of claim 36, wherein said edge portion of said bedding material is impregnated with a molded plastic material and said eye holes are defined through said molded plastic material.

* * * * *